US010245749B2

(12) United States Patent
Moeller et al.

(10) Patent No.: US 10,245,749 B2
(45) Date of Patent: Apr. 2, 2019

(54) METHOD AND APPARATUS FOR THE FABRICATION OF AN ENDLESS BAND FROM A FIBER MATERIAL BLOCK, ENDLESS BAND AND FIBER MATERIAL BLOCK

(76) Inventors: Achim Moeller, Dresden (DE); Christian Korn, Dresden (DE); Andreas Knauff, Dresden (DE)

( * ) Notice: Subject to any disclaimer, the term of this patent is extended or adjusted under 35 U.S.C. 154(b) by 1399 days.

(21) Appl. No.: 14/122,104

(22) PCT Filed: May 22, 2012

(86) PCT No.: PCT/EP2012/002173

§ 371 (c)(1),
(2), (4) Date: Aug. 22, 2014

(87) PCT Pub. No.: WO2012/159739

PCT Pub. Date: Nov. 29, 2012

(65) Prior Publication Data

US 2014/0363606 A1 Dec. 11, 2014

Related U.S. Application Data

(60) Provisional application No. 61/489,276, filed on May 24, 2011.

(30) Foreign Application Priority Data

May 24, 2011 (EP) ..... 11004266

(51) Int. Cl.
*B27D 1/10* (2006.01)
*B27L 5/00* (2006.01)

(52) U.S. Cl.
CPC ..... *B27D 1/10* (2013.01); *B27L 5/00* (2013.01); *Y10T 428/192* (2015.01); *Y10T 428/249921* (2015.04)

(58) Field of Classification Search
CPC ..... B27D 1/10; B27D 5/00; B27D 5/006
(Continued)

(56) References Cited

U.S. PATENT DOCUMENTS 1,503,784 A * 8/1924 Dumont ..... B27J 1/00 144/130
1,814,726 A * 7/1931 Miller ..... B27L 5/06 144/130

(Continued)

FOREIGN PATENT DOCUMENTS

GB 1458529 12/1976
JP 51110061 9/1976

OTHER PUBLICATIONS

International Search Report for PCT/EP2012/002173 dated Aug. 1, 2012.

(Continued)

*Primary Examiner* — Matthew Katcoff
(74) *Attorney, Agent, or Firm* — Calfee, Halter & Griswold LLP

(57) ABSTRACT

The invention is related to a method and an apparatus (1) for the fabrication of an endless band (300) containing fiber material, in particular wood, comprising at least the following method steps: providing at least one fiber material block, the fiber material block having a face side; cutting off a plate element (31) from the face side of a fiber material block, the plate element (31) having a cutting surface from the fiber material block, a main surface facing the cutting surface, and an edge surface connecting the cutting surface and the main surface; arranging in relation to each other the cutting surface of the plate element (31) and a fiber material block such that the main surface of the plate element (31) follows the face surface of the fiber material block, wherein said face surface forms the main surface of a further plate element; connecting the plate element and the further plate element (Continued)

Figure 1A:
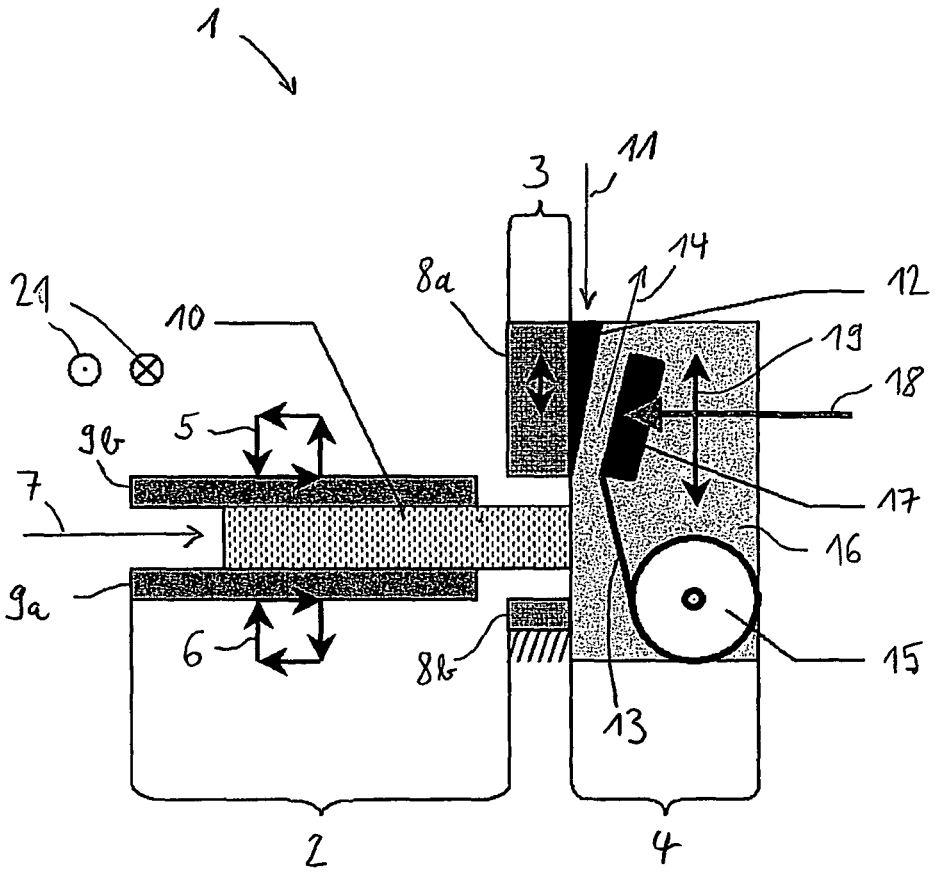

by a connecting means; cutting off the further plate element from the face side of the fiber material block. The invention is further related to the endless band (300) and the fiber material block, which is the source for the fabrication of the endless band (300).

12 Claims, 7 Drawing Sheets

(58) Field of Classification Search
USPC ..... 144/163, 164, 175, 182
See application file for complete search history.

(56) References Cited

U.S. PATENT DOCUMENTS 2,592,782 A * 4/1952 Zweifel ..... B27L 5/06 144/162.1
2,604,913 A * 7/1952 Bamford ..... B27L 5/06 144/147
2,771,923 A 11/1956 Torwegge et al.
3,562,045 A * 2/1971 Hasegawa ..... B27D 1/10 156/159
3,670,614 A * 6/1972 Streckert ..... B23D 33/006 83/208
4,930,556 A * 6/1990 Prihoda ..... B27D 1/00 144/209.1
5,383,504 A 1/1995 Cremona
5,662,760 A * 9/1997 Tsuda ..... B27D 1/00 100/38
5,968,625 A * 10/1999 Hudson ..... B32B 21/13 428/58
2005/0000185 A1* 1/2005 Edgar ..... B29C 70/20 52/847
2008/0213532 A1* 9/2008 Engel ..... B27L 5/00 428/106
2009/0000730 A1* 1/2009 Bosson ..... B27M 1/08 156/264
2011/0236661 A1* 9/2011 Rossi ..... B27L 5/00 428/215

OTHER PUBLICATIONS

Communication Under Rule 71(3) EPC dated Jul. 1, 2013.
Communication Pursuant to Article 94(3) EPC dated Apr. 20, 2012.
Response and Amended Claims dated Jul. 12, 2012.
Extended European Search Report dated Nov. 8, 2011.

* cited by examiner

METHOD AND APPARATUS FOR THE FABRICATION OF AN ENDLESS BAND FROM A FIBER MATERIAL BLOCK, ENDLESS BAND AND FIBER MATERIAL BLOCK

CROSS REFERENCE TO RELATED APPLICATIONS

This application is the U.S. national phase entry of PCT Application Number PCT/EP2012/002173, having an international filing date of May 22, 2012, which in turn claims priority to European Patent Application Number 11004266.0, filed on May 24, 2011, and U.S. Application No. 61/489,276, filed on May 24, 2011, the entire contents (each) of which are incorporated by reference herein.

The invention relates to a method for the fabrication of an endless band containing fiber material, in particular wood, an apparatus for applying the method and the corresponding endless band containing fiber material.

PRIOR ART

Sheets of fiber containing material such as sheets of wood veneer are used for covering massive bodies, like core materials of furniture, or of floor- and door panels, etc. By using such a material, the surface of the core body is subsequently provided with the properties of the cover material, in particular, the visual appearance and/or the structural properties of the sheets. Moreover, the sheets of fiber containing material can be used to assemble fiber containing bodies, which are influenced by the structural properties of the sheets, e.g. within the formation of plywood.

Compared with fibrous material in the form of single sheets, an endless band containing fiber material offers the additional advantages that it can be used to cover larger surface areas than it would be possible with single sheets, be stored easily by coiling it up, and that the automation of further processing of the plane fiber material is facilitated.

Endless bands of wood veneer are fabricated by first, cutting single sheets of wood veneer from a wood log, e.g. according to U.S. Pat. No. 5,383,504, and by then, joining the single sheets of veneer to form an endless veneer, e.g. according to U.S. Pat. No. 2,771,923. This way, it is usually necessary to precisely cut the edges of the veneer sheets before joining the same, and also to provide a safe storage- or transport condition for said veneer sheets. The joining of the veneer sheets requires the precise alignment of the veneer sheets to be joined, the application of glue, and the final conglutination of the sheets. This way, the fabrication of an endless band of wood veneer usually requires the control of many fabrication steps, including the application of different apparatus, which results in a relatively complicated process for fabricating an endless band of veneer.

OBJECT AND ADVANTAGES OF THE INVENTION

The object underlying the invention is to provide a simplified method and an efficient apparatus for the fabrication of a valuable and reliable endless band containing fiber material.

The object is met by the method according to claim 1, the apparatus according to claim 8, the endless band according to claim 11 and the fiber material block, which is the source for the fabrication of the endless band according to claim 12.

The method according to the invention offers the advantage that the steps of: i) cutting off a plate element, in particular sheets of wood veneer from a fiber material block; ii) arranging the plate element at the block; and then iii) cutting off again a further plate element to constitute an endless band; are consecutive steps of a combined fabrication process that is fast and reliable and can be performed by a single apparatus. In particular, the method can be applied without the need of storing or transporting a stack of plate elements, or wood veneers, before the assembly of the plate elements to form an endless band.

Moreover, the invention, or at least preferred embodiments of the invention, offer at least one of the following advantages: the endless band according to the invention can be used for providing interesting structural and decorative properties to a surface; at the same time, said properties are provided to the endless band in homogeneous manner, when applying the fabrication method according to the invention, in particular, when starting from a single fiber material block; further, the endless band is a versatile product, which can be used for forming or covering either two-dimensional or three-dimensional surfaces; compared to prior art methods for the fabrication of endless bands, the method according to the invention is easier to realize and is a more economic industrial method for the fabrication of endless bands; the fiber containing material in stock, in particular, residual wood veneers, can be utilized in a more flexible, more economic and more ecologically friendly way to provide the blocks of fiber material, which are the basis for producing the endless band; in particular, a high variety of fiber materials can be used, for example, wood, bamboo, hemp, grass, etc.; generally, new markets can be entered and new business models can be developed by using the present invention or its preferred embodiments.

SUMMARY OF THE INVENTION

In one embodiment, the present invention relates to a method for the fabrication of an endless band from at least a fiber material block in particular a fiber material block comprising wood, comprising at least the following steps:

- cutting off a plate element from a face side of the fiber material block, the plate element having a cutting surface from the fiber material block, a main surface facing the cutting surface, and an edge surface connecting the cutting surface and the main surface;
- arranging in relation to each other the edge surface of the plate element and the fiber material block such that the main surface of the plate element follows the face surface of the fiber material block, wherein said face surface forms the main surface of a further plate element;
- connecting the plate element and the further plate element by a connecting means;
- cutting off the further plate element from the face side of the fiber material block.

In one embodiment, within the method of the invention the steps defined above are repeated until a desired length of the endless band to be fabricated is achieved.

In another embodiment, the method of the invention comprises a step of arranging the edge surface of the plate element with a fiber material block in relation to each other, and wherein the plate element abuts on the block.

Within one embodiment of the method of the invention the connecting means is an endless connecting band.

In another embodiment of the method of the invention, the connecting means are provided to the fiber material block and/or to the plate element, before the further plate element is cut off from the fiber material block.

In another embodiment of the method of the invention the further plate element is completely cut off from the fiber material block before the plate element and the further plate element are connected by the connecting means.

In one embodiment of the method of the invention during the fabrication of the endless band, the fiber material block is automatically forwarded towards the connection end of the endless band, which is the end of the endless band to be arranged side by side with the further plate element.

In another embodiment, the cutting is performed during holding the block stationary while moving the endless band during the cutting motion towards the block.

In another embodiment the method further comprises the step of fabricating an endless fiber material block, which in particular contains fragments of a fiber material, and which is provided before applying the method according to the invention.

In another embodiment, the application relates to an apparatus (1; 1') for the fabrication of an endless band (100; 200) comprising fiber material from at least one fiber material block (10; 20; 40; 50'; 50). The apparatus may in particular be adapted for performing the method according to the present application. The apparatus comprises

- a cutting device (12; 12') which is configured to cut off a plate element (30) from the face side (20*a*) of the at least one fiber material block,
- an arranging device (12, 16, 17) for arranging a plate element (30) and a fiber material block (10; 20; 40; 50'; 50) in relation to each other, and
- a connecting device for connecting at least two plate elements.

In one embodiment the plate element within said apparatus has a cutting surface from a fiber material block, a main surface facing the cutting surface, and an edge surface connecting the cutting surface and the main surface, and wherein the apparatus is further configured to

- arrange the edge surface of a plate element and of a fiber material block in relation to each other by means of the arranging device such that the main surface of the plate element follows the face surface of the fiber material block, wherein said face surface forms the mains surface of a further plate element;
- cut off the further plate element (31) from the face side of the fiber material block by means of the cutting device; and
- constitute an endless band from the plate element and the further plate element, wherein the plate element and the further plate element are connected by means of at least one connecting means.

In one embodiment the apparatus of the present invention additionally comprises at least one or all of the following components:

- a block holder device (2) for holding the fiber material block;
- a block forwarding device (5, 6) for forwarding the fiber material block, in particular in automated synchronization with the operation of the cutting device (12);
- a block pressing means (3), preferably capable of fixating the block with respect to any stationary fixated part;
- a band processing device (4);
- a band holding and/or fixating device (12, 17);
- at least one driving device for driving one of the movable components of the apparatus;
- a device or mechanism for correlating the relative motion of at least two components of the apparatus, e.g. relative motion of the block holder device and the band processing device;
- at least one electrical control device.

In one embodiment of the apparatus of the present invention the band processing device comprises the arranging device, and the band processing device is movable with respect to any stationary part, in particular with respect to a stationary fixated part of the apparatus.

The invention also relates to an endless band (100; 200) containing fiber material, in particular obtained by the method according to claim 1, in particular a 3D-endless band, having

- a plurality of plate elements cut off from the face side of a fiber material block,
- at least one connecting means connecting a plurality of plate elements,
- wherein the plate elements, respectively, have a cutting surface from the fiber material block, a main surface facing the cutting surface, and an edge surface connecting the cutting surface and the main surface, and
- wherein the edge surface of a plate element and the edge surface of a further plate element are arranged such that the main surface of the plate element follows the main surface of the further plate element.

In also relates to a fiber material block (20; 40; 50) configured to be usable for being applied as the basis material for forming the endless band, the fiber material block comprising or substantially consisting of sub-building parts, in particular random fragments, or of veneer layers arranged in a predetermined sequence.

It also relates to an endless band, wherein

- the plate elements forming the endless band comprise different sub-building-parts, in particular strip elements, or substantially consist of different sub-building-parts, which are preferably made from veneer, received by cutting a fiber material block as defined above, which preferably consists of layered veneers.

It also relates to an endless band, wherein

- a predetermined sequence of the strip elements within the endless band and within the block, which has been the basis material for forming the endless band, is provided, wherein the sequence was determined according to at least one criterion.

In another embodiment, the application relates to the use of the endless band containing fiber material as defined above for forming or covering a surface, e.g. the interior of cars and other vehicles, such as boats, in particular a curved surface, of three-dimensional bodies or parts, e.g. of furniture.

Further advantages will be discussed with reference to preferred embodiments of the invention, which are described in the following: The invention will be described with reference to fiber material being wood or wood veneer. However, the invention is also applicable to other fiber containing materials: e.g. fiber composite materials.

DETAILED DESCRIPTION

Fiber Material Block (all Embodiments)

Fibrous material offers the advantage of a relatively high tensile strength in the direction of the fiber at a relatively low weight. The principle of fiber reinforcement is immanent to natural products like wood, and is utilized in fiber composite materials.

The block, which is source material for creating the plate elements, in particular, the wood veneer or sheets of wood veneer fragments, preferably, comprises material with fibers, or consists of such material, at least partially or completely. Said source material preferably is wood, namely natural wood, which preferably, has been received by cutting down trees, further preferably, by cutting out a wood log from said tree, and further preferably, by cutting out a piece of massive wood from the log. However, it is also possible that the material of the block does not contain fibers and that the plate elements, which are part of the endless band also do not contain fibers, and that the endless band does also not contain fibers, as long as the endless band according to the invention achieves the required stability, which may depend on the desired application. However, the present invention has a focus on the use of fiber material, in particular of wood, for fabricating the endless band.

Generally, it is preferred that the source material contains renewable primary products, e.g. wood or other plant material, respectively. Renewable primary products can comprise natural fibers, e.g. woody or non-woody, e.g. natural fibers, as defined by the industrial norm ISO 6938:1984, for example. It is preferred, that the material is plant material and that the fibers are vegetable, in particular fiber crops, preferably, plant fibers based on cellulose and/or lignin. Said material is preferably natural wood, which naturally contains wood fibers. Natural material with natural fibers, in particular, wood, is environmentally friendly, healthy, and widely valued for its aesthetic properties.

The fiber material block, preferably, has an anisotropic structure; a structure, i.e. wherein the fibers are arranged substantially in parallel. However, the block may also have a substantially isotropic structure. When the cutting surface runs parallel to the fibers, cutting off plate elements from a face-side of the block is simplified. This way, the plate elements, specifically the wood veneer sheets, comprise fibers arranged in parallel and therefore, such plate elements have a high tensile strength in the direction of the fibers. However, it is also possible that at least one part of the fibers, or substantially all fibers of the block, are arranged such that the cutting surface is not in parallel to the fibers and that the cutting surface has an angle >0° to <90° to the direction of said fibers.

The block can be a block of wood, e.g. of layered wood, in particular, of laminated wood, and/or of a composite of wood and one or more additional materials. In particular, the block can comprise fragments of wood. The layers or the fragments can be glued against each other, e.g. with a water-comprising adhesive, with a waterfree-adhesive, or with a polyurethane glue, or with a dispersion adhesive.

If the block is a work-piece of massive wood, e.g. a wood log or a segment of said wood log(a "flitch"), it is preferred that the cutting surface for cutting of the plate elements is arranged substantially in parallel to the wood fibers, which then makes cutting easier. However, it is also possible that the cutting surface is at an angle >0° and up to 90° to the wood fibers. When the cutting surface is arranged in parallel to the wood fibers then plate elements of wood veneer, which look like sawn pieces of wood that have been cut across the growth rings of a tree, are obtained.

If the block is a work-piece of layered wood it is preferred that at least one layer or otherwise all layers, are the same type of plane wood, e.g. boards or board-like plates with a thickness of 6 mm or larger. The board-like layer can be of a massive wood board, or a reconstituted wooden board, e.g. a flake board, a plywood board, an oriented strand board (OSB), a medium-density fiberboard (MDF) or a low-density fiberboard (LDF). The board-like plate can also be of a reconstituted board, analogous to the reconstituted veneer described below.

In another embodiment the fiber material block, in particular, an endless fiber material block may be made from fragments, in particular, of sheet fragments of fiber material, e.g. of wood or veneer.

The method of manufacturing fiber material blocks as defined above, comprises the steps of: the manual or automatic laying of fragments or packages, or fills of fragments; and, preferably, of connecting them by glue or preferably compressing them. Reference to such a block is made later in the description of FIGS. 5*a* and 5*b*, which contain additional preferred aspects and embodiments of such a block, and the method of its fabrication. Said method enables automated fabrication of the block and the fabrication of the endless band on the basis of said block.

Preferably, at least one layer, or otherwise all layers, of the layered block are veneers or veneer-like sheets of wood. The term "veneer" represents a distinct species of a wood sheet having a thickness of typically: 0.1 mm to 6 mm, e.g. 0.1 mm to 3 mm, about 0.45 mm to 2.5 mm, 0.45 mm to 1.3 mm. The terms "veneer sheet", "wood veneer", or "sheet of a veneer" are interchangeably used for the term "veneer". The veneer can be, for example, a sliced veneer (produced by horizontal or vertical slicing), a peeled veneer (produced by rotary slicing), or a veneer produced by staylog technique (eccentrical rotary slicing).

The veneer can also be of a reconstituted veneer, for example a veneer fabricated according to the method described by GB 2 236 979 A. A reconstituted veneer can be fabricated by arranging conventionally manufactured veneers, such as peeled veneers, face-to-face, in particular, gluing them to each other The so obtained composite material is subsequently, re-sliced to receive reconstituted sheets of veneer, which are formed by veneer rods or strips, and arranged stacked or, respectively, side-by-side. This allows the fabrication of heterogeneous endless-bands with a mosaic-like structure.

The veneer used for composing layered wood may be specifically designed to achieve predetermined aesthetical properties, mechanical and/or optical, of the endless band of veneer. The employed wood and glue may, for example, be colored or dyed. Furthermore, due to the possible use of hardwood, scratch-resistant veneers may be produced. The use of different wood species as well as the incorporation of non-wooden material, such as metal or metal powder, glitter, plastic, etc., is also possible in order to vary the mechanical and optical properties. The produced endless band may be easily processed. Furthermore, an advantageous use of lower grade veneer for the manufacture of said block, or a flitch, is also possible without diminishing the properties of the endless band to be produced. Other advantages of an endless band are described below.

In particular, for the use in a block of layered wood, different veneer types, different species of wood, different patterns from wood and other materials, from colored or dyed adhesives, etc.; can be produced and can be converted according to customers' requirements.

The block, containing wood or veneer, can also comprise further materials, preferably glue, adhesion promoter, technical fibers (e.g. glass, carbon, aramid), or others.

According to a preferred embodiment of the invention, one or more fiber material blocks are provided, each block comprising or consisting of a stack of veneers. Within each stack of veneer, the veneers are arranged according to a predetermined sequence, which can be chosen according to at least one criterion that influences, in particular, the properties of the endless band to be fabricated. The veneers can, for example, be made of the same species of wood, or of different wood species, or of colored wood. A predetermined sequence of the veneers offers the advantage that the properties, in particular, the visual appearance, of the endless band can be tailored. Such a layered block with a predetermined sequence of plate elements, specifically veneers, arranged side-by-side, or on top of each other, is a preferred basic material for an embodiment of the invention, and is inventive, and can also be claimed independently from the method, the apparatus, and the endless band according to the invention.

Furthermore, starting from a stock of more or less different veneers that are available, the sequence can be adapted such that the different veneers are optimally distributed over the stack of one or more fiber material blocks to create the desired properties of the material and/or to optimize the distribution of the different veneer material (strip elements) over the endless band. This way, it is generally possible to minimize the residual material and the refuse material that are produced during the production of one or more endless bands. This also affects the flexibility and the storage needs for a production environment of an apparatus for fabricating endless bands, since only a predetermined number of veneers are required to be produced, stored and then supplied for producing a block of predetermined structure and dimension, which is then tailored and adapted to lead to an endless band, which corresponds to the format ordered by an end-user.

Preferably, said criterion for predetermining the sequence of veneer in the layered block is to allow fabrication of an endless band with a homogeneous visual appearance. Here, the sequence of veneers from the stock is intentionally arranged such that it results in a preferably homogeneous visual appearance with respect to color, brightness, pattern, and/or graduation.

Furthermore, said criterion for predetermining the sequence of veneer in the layered block can be such that an endless band with a specific texture that imitates the texture of known woods: e.g. beech, oak, maple, etc is created. Using a layered block, the texture of the endless band can also be made random, at least partially, e.g. within a section of the endless band, or within substantially, the entire endless band.

Furthermore, by using means for digital processing, e.g. a digital camera and/or computers, the individual face surfaces and/or edge surfaces of available veneers can be digitally recorded, and in a further step, with computing means, which are configured by a suitable program code, they can be configured to calculate one or more specific sequences of veneer within the layered block. The sequences fulfill a specified criterion that can be used to yield a specific texture: of the plate elements to be cut from the block, and of the endless band. For example, the program code can be configured to predict one or several textures of the endless band, which can be received by a stock of available, registered veneers, and the predicted textures can be graphically visualized on a screen and/or a monitor. With such computing means, different veneers or positions of strips of veneers can also be chosen to be transported into buffers, followed by picking and placing veneers individually, according to commands from a design software. Each specific texture, chosen for fabrication, is then correlated to a specific sequence of veneers within a layered block. In order to provide a semi-automatic, an automatic apparatus, or a station for producing an endless band; means for sorting the veneers can be provided, in particular, for sorting depending on a predetermined sequence of veneers, and/or means for stapling the veneers, and/or means for gluing or for laminating the veneers, to form a layered block. These means can be part of the apparatus according to the invention, respectively. Alternatively, said different means and the apparatus according to the invention could be connected to form a station for producing an endless band, which can be semi-automatic or automatic, using, for example, additional means for transporting, and/or for lifting the veneers, and means for signal connection, e.g. cable or wireless data transfer means, for exchanging data between the means of the station. This embodiment can represent a powerful tool to the designer of the endless band, or to the end-user of the endless band.

The veneers, constituting a layered block, can be of reconstituted veneers, which have been produced by being cut from another layered block. In a layered block of reconstituted veneers, preferably, a veneer composed of strip elements, arranged side by side in parallel to the wood fibers, a strip element can be divided or separated into "spot elements." A layered block of reconstituted veneer, can be cut such that the cutting surface is in parallel to the fibers, which makes cutting easier, or that it is not in parallel to the fibers, for example cut in an angle of 90° to the fibers. As a result, the plate element, which is cut from such a layered block, can comprise spot elements instead of strip elements, and the spot elements can have similar length and width. This way, the endless band can comprise, or its surface may substantially, consist of, an array of spot elements. Such a composition offers additional possibilities for the visual appearance of the endless band, such that the spot elements act like pixels of a picture, and also contributes to the mechanical properties of the endless band. Hence, endless bands with interesting properties can be provided in particular, in combination with a computer aided design of the endless band and of the plate elements.

Moreover, a layered block can be used to produce an endless band with 3D-formable properties (3D-endless band). Such a 3D-endless band contains the plate elements side-by-side and cut from the layered block, wherein the plate elements are veneers with strip elements of veneers. The strip elements contain wood fibers arranged substantially in parallel to the length of the strip element, such that the strip element has a high strength against tensile load along the direction of the strip element. A 3D-plate element (3D-surface element) alone, is known to be suitable for producing layered three-dimensional formed parts of various forms, or for covering or coating other 3D-formed components, e.g. furniture, rails, dashboards, and the like, of various materials. The technology for producing and applying 3D-veneer sheets is described in DD 271 670 B5.

A preferred option to implement the 3D-capability of the 3D-endless band is that the strip elements have a substantial individual displaceability within in the layer of the 3D-endless band (internal displaceability) for allowing the adjacent strip elements to have different radii of bending, which implies a relative displacement of two adjacent strip elements. This means, in a 3D-endless band it is possible to individually bend the strip elements even if they are connected to each other, e.g. by an elastic glue that can connect and/or separate the strip elements. Preferably, adjacent strip elements are not connected at their respectively opposing side faces. However, they usually are connected within the 3D-endless band by the connecting means. The connecting means are then preferably configured such that a relative displacement of adjacent strip elements (within a certain tolerance) within the 3D-endless band is possible or can be made possible, by an after-treatment of the 3D-endless band, for example. An endless connecting band or a fleece, which can be elastic and which has a certain displaceability in the direction along the length of the strip elements would be sufficient to provide the internal displaceability of the strip elements. While not mandatory, it is possible the displaceability can be in the direction of the length of the 3D-endless band. This way, adjacent strip elements that are connected to the connecting means and fixated with respect to the direction of the length of the 3D-endless band, are able to perform a relative displacement motion along the length of the strip elements.

The strip elements have, preferably, a width W in one of the following, respectively preferred, ranges of {0.1; 0.3; 1} mm<=W<={10; 25; 50; 75; 100} mm.

It is advantageous to adjust the moisture contents of the wood within the block, of the plate elements, and/or the 3D-endless band. For example, the 3D-endless band can, preferably prior to its inventive fabrication, be brought to a wood moisture content of greater than 10%, preferably to approximately 15%-22%. A further advantage is that said 3D-endless band is much more 3D-deformable since the individual strips can be bent in smaller radii compared to bending at normal moisture equilibrium. This effect can be further increased if additional heating of the 3D-endless band takes place, prior to the 3D-deformation.

In the application of the 3D-endless band, the high moisture content is reduced to the conventional amount during a subsequent hot-pressing of the 3D-formed part. As a consequence of the thus achieved, improved fusibility of the 3D-endless band, cracks or gaps that might occur during the pressing (3D-forming) process are effectively closed.

If the increased wood moisture already exists prior to the production of the 3D-endless band, the cutting forces required are reduced, and consequently, machine wear is reduced.

Pursuant to a further advantageous variant, a fire retardant and/or a fungus inhibiting material may be added.

For selected applications, the 3D-endless band is treated with a known impregnating resin. Such a resin penetrates into the interior of the material (wood) structure, and also wets the surface of the strip elements of the 3D-endless band. The resin is such that it becomes liquid during heating (prior to the 3D deformation) and thus, enables the shifting of the strips of the 3D-surface element. In addition to improving the resistance to water, which is generally known for impregnated material (e.g. wood), it is also advantageous that the reversible gluing of the strip elements of the impregnated 3D-surface elements is possible.

Further details of the 3D-plate element (3D-surface element) and of its fabrication method, its treatment, and its use are described in US 2004/0144448 A1, which is hereby incorporated by reference. The 3D-endless band preferably, is an endless band of veneer.

By using a 3D-endless band, the storage and transport of 3D-surface elements, being now continuous 3D-endless bands in form of coils, becomes more efficient and safe, resulting in less product damage. Moreover, the process for the fabrication of 3D-surface elements is more economic and 3D-surface elements can be produced by using more cost-saving materials.

The block, or the boards, or veneers of a layered block can comprise strands, flakes, or veneer fragments of wood, in particular, residual pieces or fragments of wood, or chips of wood, or it can consist of such fragments of wood at least partially or completely. Said fragments of wood can be formed, e.g., flat, plane, and/or plate-shaped. The fragments can be glued among themselves, e.g. by a water-comprising adhesive, or by an adhesive with polyurethane, or a dispersion adhesive. The block or the layers of a layered block can be pressed more or less, to adjust the density of the wood fragments. Plate elements, which are cut from such a block, can have an adjusted density, and can have a density lower or higher than the density of the massive wood of the original material of the wood fragments. In particular, lightweight plate elements and lightweight endless bands can be provided, wherein an endless band can be used, for example, to provide the core material of a composite endless band or a composite plate, which, for example has also at least one cover layer in the form of, for example, another veneer endless band or a veneer.

Preferably, the shape of the block is a cuboid, and more preferable is a cuboid with at least two opposing parallel faces: preferably, at least one plane face surface, preferably, a rectangular cuboid. This allows to cut off plane plate elements from the face side of the block and to directly arrange said plate elements with parallel edge surfaces, side by side, to form the endless band, without the need of additional steps of cutting plate elements, e.g. if a gap-free, preferably seamless, connection of plate elements is desired in the endless band.

It is preferred that more than one block, in particular an endless block is provided to form an endless band. Preferably, at least two blocks are used consecutively to form an endless block as the source material for the fabrication of the endless band, e.g. by using at least two blocks of the same width or, specifically, the same shape, which are then lined up in series to fabricate the endless band in a non-stop process. The two or several blocks are joined, preferably, by connecting them with a block connecting means, e.g. with a glue. It is also possible to join the two or several blocks by arranging them side-by-side, e.g. attached to each other with or without the use of a block connection means. By using more then one block, the fabrication of the endless band becomes even more efficient. Moreover, by using blocks of different structure, e.g. of different composition, color, or density, endless bands with different band sections can be provided.

Preferably, the orientation of the block does not change during the fabrication of the endless band. This leads to a substantially uniform appearance of the endless band fabricated from the block. It is possible to change the orientation of the block during the fabrication of the endless band, e.g. by rotating the block preferably, 90° or 180° around its height, width, or length axis, such that at least two consecutive plate elements of the fabricated endless band show the corresponding difference of orientation. This way, an endless band with non-uniform appearance can be fabricated efficiently. Such a result can also be achieved by using two or several blocks, which are exchanged between at least two steps of cutting a block, for fabricating an endless band.

Preferably, all plate elements of an endless band are cut off from the same block. This allows fabrication of an endless band of high homogeneity with respect to the visual and mechanical properties of the band. It is also possible to use more than one block for fabricating, in a substantially continuous manner, one or several endless bands. For example, rectangular blocks of preferably, the same size and shape could be arranged lengthwise in series, with their two respective smaller side surfaces opposing and attaching each other. Said blocks could be connected to each other, in particular, their attaching side surfaces could be connected to each other by glue.

It is also possible to hold at least one fiber material block in a block-holding-means, which can be part of or associated with the apparatus. The block-holding-means can comprise transport means for transporting, in particular, for forwarding, the block towards the arranging device and the cutting device according to the invention. This way, the substantially continuous process of fabricating the endless band is highly efficient.

Moreover, the block holding means can be configured to be capable of holding and/or of transporting more than one block. The holding means can comprise means for positioning the at least one block, e.g. by rotation and/or by translation of a holder, which holds the blocks. This way, several blocks can be used in a substantially continuous process of fabricating the endless band, which gives more flexibility for designing the endless band.

The term "water-comprising adhesive" defines any compound which contains water and which is capable of adhering at least two of said first wood sheets with each other, in order to form a block comprising said first wood sheets. Said compound may be present in said water in the form of a solution, an emulsion, a suspension, or a dispersion. Accordingly, the terms "solution", "suspension", "emulsion", and "dispersion" are interchangeably used herein. The term "adhesive" is interchangeably used with the term "glue". The terms "adhering" and "gluing" are interchangeably used.

It is also possible, that the material of the fiber material block is a non-natural material, in particular a man-made material, for example, a fiber composite material. Such a material can comprise a matrix material, which contains fibers. The matrix material can be, for example, of different plastics, resins, metals, ceramics. The fibers can be cellulose fibers, glass fibers, carbon fibers, aramid fibers, etc.

The orientation of the fibers in the fiber material, in particular regarding the block, the individual layers of a stacked block or reconstituted block, or the plate element can be substantially unidirectional, which means that all fibers from one of said components are substantially in parallel. However, it is also possible that the orientation of the fibers is multi-directional, which means that the fibers of a block are oriented in more than one direction. In particular, a discrete number N>2 of preferential directions of the fibers in the material can be provided, or the distribution of fibers can be random. Furthermore, the individual layers in a stacked block or reconstituted block can be substantially unidirectional and be arranged in parallel to a preferential direction, while the preferential directions of the layers can be at least in part different.

Plate Element (all Embodiments)

A plate element is a flat element containing fibers, whose width W and length L are larger than its height H, preferably by a factor of, respectively, c>=2, 5, 10, 25, 50, 100, 1000, or different, such that H*c=W and H*c=L. The height of a plate element can be the height (=thickness) of a veneer, or it can be different from it. Preferably, the plate element is a veneer or a reconstituted veneer. The plate element, in particular the veneer, is preferably distortable or flexible, or capable to be bended along at least one axis of rotation, and also preferably, along at least two axis of rotation, which can be perpendicular. Further, the plate element can also be substantially stiff, e.g. substantially, inflexible.

Preferably, the fibers of the plate elements, or of the veneers are arranged substantially in parallel to the main surface and to the cutting surface of the plate element. In a substantially plane cuboid-shaped plate element, the fibers are preferably arranged in parallel to one of the straight edges of the plate element. However, it is also possible that the fibers are not oriented in parallel to the main surfaces of the plate element or to its edges. In a layered block it is possible to use veneer with wood fibers, which are arranged substantially in parallel to the main surface and the cutting surface of the plate element. However, the fibers can also be arranged in an angle of >0° and <90° with either, the main surface, the cutting surface, or a side surface, or an edge of the plate element. Stated differently, the orientation of the fibers may be freely chosen depending on the desired optical appearance within the end product, e.g the endless band and/or any device made by using said endless band.

Preferably, a plate element is a veneer, preferably a reconstituted veneer, produced from a layered block.

Connecting Means

The connecting means are suitable for connecting the plate element and the further plate element, preferably more than two plate elements, but not necessarily all of the plate elements. All of the plate elements of an endless band could also be connected. If the plate element substantially consists of sub-building parts, e.g. strip elements or spot elements forming an at least partially or a completely fragmented endless band, then, preferably, the at least one connecting means is arranged such that each building part or, specifically, each surface of a building part, which contributes to the main surface of a plate element, is connected with the connecting means. Thereby, the stability of the fragmented endless band is enhanced. In a preferred embodiment, the connecting means and the arrangement of the plate elements are the main components of the endless band.

The preferable connecting means is an endless connecting band, which is preferably connected to, or specifically, glued to the plate element, and the further plate element of the endless band is connected to, or specifically, glued to the main surfaces of the plate elements, and specifically to multiple or all of the plate elements of an endless band. The glue can, for example, be a water-comprising adhesive or it can be a polyurethane based glue. The endless connecting band connects plate elements of the endless band and, preferably, is configured as a continuous carrier material, which carries and fixates the plate elements of the endless band. The endless connecting band can be configured to be self-adhesive or, alternatively, it can be provided with a glue before the assembly of the endless connecting band with the plate elements. The endless connecting band can also be provided with further connecting means other than glue, for example, with clamping elements or with members, providing a form-fit between neighboring plate elements, or with nail-, hook-, or screw-elements, with hook-and-loop based fasteners, e.g. Velcro®-based fasteners.

It is also possible that in an endless band, the connecting means, respectively the endless connecting band, is connected to an edge surface of a plate element and to an edge surface of a further plate element, thereby connecting the plate elements. Preferably, the connecting means, respectively the endless connecting band, is connected to multiple or all of the plate elements, and respectively, connected to the edge surfaces of each plate element, which form one edge surface of the endless band. Preferably, two connecting means, respectively two endless connecting bands, are provided, each connected to one of the two edge surfaces of each plate element, which form one edge surface of the endless band. In such an embodiment, the main and the cutting surface of the plate elements of an endless band are preferably, not occupied by the connecting means, this can then simplify further processing of the endless band.

The endless connecting band can be an endless adhesive material, e.g. an adhesive thread, or several adhesive threads, which can be arranged to form a network, an adhesive fibrous web, or a fleece, an adhesive tissue, an adhesive foil, an adhesive plastic, or a plastic melt. Depending on the type of connecting means, the plate elements, or the building parts of the plate elements, e.g. the strip elements, preferably, still have a certain lateral movability within the endless band or a parallel movability with respect to the edges of the plate elements or with respect to the building parts. In particular in the case that the plate elements are fragmented (strip elements, etc.), the capability of the endless band to be 3D-formed is enhanced.

The endless connecting band can be a composite band, e.g. a layered band. One layer can comprise the adhesive, another layer can be configured to add tensile strength to all layers of the endless connecting band, for example, by fibers within said layer, thus, forming a carrier matrix. The fibers can be substantially arranged in parallel or they can form a network, or a mesh. Said fibers can, for example, be cellulose based, textile fibers, glass fibers, carbon fibers, or aramid fibers. Preferably, said fibers or the arrangement of said fibers provides elasticity to the connecting means, e.g. when using elastic fibers.

The connecting means is, preferably, configured to be removably connected to the plate elements such that after the fabrication, the storage and/or the application of the endless band, the connecting means can be removed. This can be useful for a body, e.g. a piece of furniture, which is initially covered by an endless band of veneer, but subsequently, the connecting means is removed for revealing the undamaged main surface of the plate elements. Alternatively, at least one part or one layer, respectively, of the connecting means (or substantially all of the connecting means) can be first removed from the endless band, to yield a modified endless band, which subsequently can be processed to cover the body of, e.g., a piece of furniture.

The width of the endless connecting band preferably is equal to the width of the endless band, or at least to the width of a section of the endless band. However, the width of the endless connecting band can also be larger, which can be useful for storing and protecting the plate elements of the endless band. The width can also be smaller; thus, avoiding that too much area of the main surfaces of the plate elements is occupied by the connecting band or the glue. It is possible to use a number of two, three, four, or more endless connecting bands, arranged, preferably, in parallel and, preferably, spaced apart from each other, to connect the plate elements. The width of said bands is preferably, smaller than the width of the endless band divided by said number, but can also be different.

The at least one connecting means can also be configured, in particular, to not connect all of the plate elements of an endless band but to connect only two or a group of plate elements, or building parts (fragments) of a plate element. For example, connecting members can be used, e.g. self-adhesive members, which are transferred to the endless band to connect two neighboring first and second plate elements of the endless band by providing at least one point of connection to the first (initial) plate element and at least one point of connection to the second (further) plate element, preferably on the main surfaces or on the edge surfaces of the plate elements. In this case, usually a plurality of connecting members are required to enable the fabrication of a continuous endless band. The connecting members can be stored on an endless carrier band. The endless carrier band can be coiled during the storage, and hosts the connecting members spaced apart in distances, which are adapted to the distances of the edge surfaces of the plate elements of the endless bands. Upon application of the connecting members, the endless carrier band could then be uncoiled and the connecting members could be applied in a substantially, continuous process.

Moreover, the connecting means can be arranged substantially between two neighboring plate elements of the endless band. Preferably, it can also be arranged at the opposing edge surfaces of two neighboring plate elements of the endless band. The neighboring plate elements can be glued, e.g. with a water-comprising adhesive or a polyurethane based glue. The glue can be provided to the edge surface of the plate element, which has just been cut off from the fiber material block, and/or it can be provided to the lateral edge surface of the face side of the block before the edge surface of the plate element is attached to said lateral edge surface, so that the main surface of the plate element follows the face surface of the fiber material block, wherein said face surface forms the main surface of a further plate element. Alternatively or additionally, the glue can also be provided to the lateral edge surface of the face side of the block, before the edge surface of the plate element is attached to said lateral edge surface. The fabricated endless band can therefore contain plate elements, which are attached side-by-side with their respective edge surfaces, which are, preferably, connected to each other by glue.

Furthermore, additional or alternative connecting means can be provided for stabilization, and/or for protection of the endless band, e.g. said additional connecting means could be an endless connecting band, or an endless protection band, e.g. in the form of a planar, flexible material, such as a foil, a web, or a fleece.

Moreover, the edge sides of the plate elements, which are facing each other, can be configured such, to have form-fit elements or, respectively, key-and-slot-shaped elements, like, the connecting parts of a jigsaw puzzle, which are capable of connecting adjacent plate elements by a form closure. A key element can be positioned at the edge surface of the first plate element and the slot element could be located at the opposing edge surface of the neighboring, second plate element. Preferably, two of such elements are provided on each edge surface, which are positioned, preferably, in a maximal distance, in order to preferably spare the visually seamless connection line between neighboring plate elements of the endless band. The key-and-slot-shaped elements can be prepared by shaping the opposing sides of the plate elements by cutting, e.g. by die cutting. This step can be done before cutting the fiber material block, e.g. by providing one face side or opposing face sides of the block with grooves and/or bars, or the step can be done, at least in part, after cutting off the plate element from the fiber material block. In such an embodiment, the main surface, the cutting surface, and or the free lateral edge surfaces of the plate elements of an endless band are preferably, not occupied by connecting means, which can simplify the further processing of the endless band.

The connecting means may be constituted by substances that are within the fiber material constituting the endless band, such as lignin in wood. In the case of wood, lignin may be extracted from the wood by heat and/or pressure, which may be achieved by a respective heat and/or pressure treatment of the starting wood material prior or during the process of the present invention. In one embodiment, the fiber, e.g. wood, material block is subjected to such a treatment prior to the method of fabricating an endless band. Said connecting means may be the substance being naturally within the fiber material block or may be added to same. In this embodiment, the "connecting device" is the device, which is responsible for extracting, activating or modifying the connecting means, e.g. lignin. Examples for such connecting devices are heating and/or pressure and/or irradiation means.

Further, the face surface of the block can be provided with connecting means, e.g. one or more adhesive bands or foils or with an adhesion promoting substance and/or with a glue, before a plate element is cut off from the face side of the block, such that the main surface of the received plate element is provided with a connecting means, before it is connected to a further plate element with further connecting means.

Adjacent plate elements forming the endless band can be connected in different manners, which may be freely chosen by the person skilled in the art. Adjacent first and second plate elements forming a section of the endless band can be e.g. connected according to the following embodiments: i) substantially at the same time, when the first plate element is arranged at the block and/or, respectively, when the process of cutting off the second plate element from the block is initiated; ii) at a time after the process of cutting off the second plate element from the block is initiated; iii) at the time when the process of cutting off the second plate element from the block is finished; iv) at a time after the process of cutting off the second plate element from the block is finished; v) at a time prior to the process of cutting off the second plate element from the block.

Another possibility within embodiment iv) defined above is to cut off completely the further plate element from the fiber material block before the plate element and the further plate element are connected by the connecting means. A generally preferred feature for defining the invention and regarding, in particular, case iv) is the following: the arrangement of the plate element and the further plate element is performed while at least one plate element, or several or all plate elements, which are arranged after the "further plate element" to form the endless band, are still part of the fiber material block, which means they have not yet been cut off from the block. The plate elements are cut off and arranged to form the endless band by one single apparatus. Regarding further case iv), the endless band can be transported such that the adjacent first and second plate element, which are arranged side-by-side, but are not yet connected, are transported to a connection station.

The connecting device is another part of the apparatus according to the invention. The connecting device is preferably arranged such that endless band, or respectively, the first and second element, is passed from the arranging device to a connection station. The connecting device provides any connecting means, described above, and serves to connect the adjacent first and second plate element, and preferably more plate elements of the endless band.

Endless Band (all Embodiments: Advantages)

Preferably, an endless band comprises two main components, the "endless" layer of a plurality of plate elements and the connecting means. Generally, the endless band contains two or more than two or several plate elements, in particular multiple plate elements. However, one advantage of the method according to the invention is that the length of the endless band to be fabricated, is not limited by the technique of the apparatus according to the invention. Additionally, coiling up the endless band after its fabricating, allows easy storage. Moreover, the forwarding of new fiber material blocks can also be performed in a substantially continuous manner, by continuously feeding new blocks to the apparatus according to the invention. The same applies for the connecting means, which can be of a coiled endless connecting band. The length of the endless band will be, rather, limited only by the maximum coil size.

The difference to known endless bands of plate elements, e.g. veneers, is in particular, that the plate elements of the endless band according to the invention, have been added to the endless band immediately after cutting them off from a block, i.e. without an intermediate step of storage, which however, is the case in conventional veneer processing. Furthermore, the endless band is usually stored as a coil, immediately after the fabrication of the respective section of the endless band. This means, that the surfaces of all plate elements of the endless band are only exposed to the surrounding atmosphere for a short period, which, is substantially, the same period for each plate element within the endless band. Therefore, any impairment of the surfaces of the plate elements, which affect the properties, e.g., visual or mechanical properties, of the plate element, like the application of water vapour or of other gases and substances to the plate elements, is substantially, the same for each plate element. For each plate element of the endless band, the exposure time between cutting off the plate element from the block and subsequent storing, e.g., in a coil, is usually substantially the same. The exposure time T is, preferably, in one of the ranges between possible lower and upper limits according to {0.5; 1; 2} seconds<=T<={3; 5; 7; 10; 15; 20; 25; 30; 40; 50; 60} seconds, but can also be shorter or longer.

As a result, the endless band according to the invention may be manufactured from e.g. wood which has the same history and origin. Thus, the endless band may be prepared such as to exhibit equally treated and equally aged surfaces, and in particular, can have more homogeneous properties along the length of the endless band compared to endless bands manufactured by conventional methods, which require for each veneer an intermediate step of storing, for unknown and various storing periods. Moreover, the plate elements of the endless band according to the invention substantially have the same age, within the tolerance of the overall time of the production of the endless band, which can be considered as negligible, compared to the storing period of veneers of conventional veneer processing. The plate elements and the endless band according to the invention are fabricated from one or more blocks in a substantially continuous process, in contrast to conventional veneer processing.

It is possible and preferred that the endless band is joined, e.g. pressed, laminated, and/or glued, with one or several further endless band(s) to form a layered endless band. For this purpose, two or several apparatus according to the invention can be used in combination and the combination of the endless bands can be performed by using a joining device. Furthermore, it is also possible to fabricate a layered endless band by one appropriately configured apparatus according to the invention, which is capable to arrange as a layer at least two of the plate elements, which have been cut off from the same or from different fiber material block(s), preferably, also capable of applying a glue as a connecting interface between two layered plate elements, and preferably, also capable of pressing at least two layered plate elements together.

The method for fabricating an endless band, which contains strip elements, comprises the additional steps of: (1) choosing a first plurality of plate elements containing fiber material, e.g. veneer, wherein the fibers of each plate element are preferably arranged substantially in parallel and/or in parallel to one or more edges and surfaces of the plate element; (2) arranging the plate elements to form at least one layered fiber material block, which represent (are) the block (s) for fabricating the endless band, wherein the fibers of a block are preferably all arranged in parallel to each other and in parallel to one side surface and one side edge of the block, and wherein the plate elements of the (layered) block are stacked in a predetermined sequence according to at least one criterion; preferably, by exchanging the blocks, constituting one single endless band using more than one block.

The endless band can be modified to supply a protective layer to the endless band, e.g. by applying an endless foil, which can be self-adhesive or otherwise arranged and/or applied to the layer comprising the plate elements. Moreover, an additional layer, e.g. a protecting layer, can also be applied to the endless band during or after fabrication.

Apparatus:

Cutting/Cutting Device

The apparatus can be configured for the automatic or semi-automatic fabrication of an endless band, using at least one fiber material block.

The apparatus for the fabrication of an endless band containing fiber material, comprises at least a cutting device which is configured to cut off a plate element from the face side of the at least one fiber material block, wherein the plate element comprises a cutting surface from a fiber material block, a main surface facing the cutting surface, and an edge surface connecting the cutting surface and the main surface. The fiber material is preferably wood, from at least one material block, preferably a massive wood log or a composite wood block, e.g. a layered veneer block. The cutting device or a cutting means, which is part of the cutting device, is preferably arranged to be movable with respect to the block, or with respect to a block holder device. The apparatus is preferably configured such that the cutting is achieved by holding the block stationary while moving the endless band, in particular preferably the band processing device, and/or the arranging device, and/or the cutting device, during the cutting motion towards the block, preferably simultaneously. However, it is also possible to move the block against at least one of said components, e.g., by lifting the block against a stationary cutting device.

The cutting device can be configured to implement specific cutting techniques, which can comprise cutting with a geometrically well-defined tool edge. The cutting device most preferably, has a cutting blade (e.g. from steel), or, possibly, the cutting with a cutting device having a saw tool or a shearing tool or a blanking tool. Moreover, depending on the block thickness, radiation-based or fluid-based cutting techniques are also possible, e.g., using a device for laser cutting or a device for water jet cutting.

The cutting device preferably is part of a band processing device, which can also comprise means for at least temporarily holding and or fixating ("band holding and/or fixating means"), e.g. by clamping, the section of the endless band, which has already been assembled in a previous step of the substantially continuous fabrication process. The band holding means can be configured to hold the band by a holding force, which can be mediated by pressure and by friction, preferably by providing parts of the apparatus which act as friction based holding and/or pressing members. For example, the band can be held by providing a first friction surface, wherein the first friction surface can be part of the cutting device, which can also be the counter bearing for pressing the band against the first friction surface. A second friction surface can be provided, which can be part of a band pressing and/or sliding element, which preferably is part of the band processing device.

The band processing device preferably is arranged movably with respect to a block holder device, which can also be part of the apparatus. The apparatus and the band processing device preferably are configured to let the band processing device perform in at least a partially translational motion or a substantially translational motion, which can, in particular repetitively, move the band processing device towards the block holding device and towards the block and back, respectively. Said motion is also used, preferably, to cut off the plate elements from the block, by the cutting means, e.g., a cutting blade.

The band holding and/or the fixating means are preferably, configured such that the endless band section is held or fixated by a holding force, with respect to the cutting device, when the band processing device and the block or the block holder device are moved away from each other, and, preferably, that the endless band section is not held, or respectively fixated, with respect to the cutting device, and preferably—at least sufficiently—released, if the band processing device and block holder device are approached and the cutting device is moved through the block. Preferably, the holding force of the band holding means is overcome during the cutting motion.

Furthermore, the apparatus for the fabrication of an endless band containing fiber material from at least one fiber material block has at least one arranging device for arranging a plate element and a fiber material block, in relation to each other. The arranging device can comprise the means for holding and/or for fixating and/or for guiding the endless band. Such means can be configured to provide an opening or a recess for allowing the endless band to pass through, and/or at least one sliding surface. This serves to let the endless band or the plate elements of the endless band glide along the sliding surface. Preferably, a sliding surface is covered by a non-abrasive material, which allows a friction-reduced sliding, e.g. a Teflon®-member or -material. Preferably, the cutting device provides a sliding surface, specifically, a low-friction surface, of the arranging device. This allows the plate elements or the endless band to pass through the arranging device in close vicinity to the cutting device, which can be a slim conical-shaped steel blade. Thereby, any possible distortion of the endless band can be minimized.

Moreover, a storing device for storing the endless band intermediately during fabrication, or after its fabrication, e.g. for an after-treatment, can be provided. The storing device can be part of the apparatus or it can be associated with the apparatus.

The apparatus preferably, comprises a block holder device, which is configured to hold the block, in particular, while the plate elements are cut off from the face side of the block, respectively. The block holder device can comprise a table or a platform for supporting the block. The block holder device can comprise a guiding device for guiding the block during the process of forwarding the block, wherein the guiding means can implement a restraint-guided motion of the block. The apparatus or the block holding device can also comprise means for transporting and/or for lifting the block. The means for transporting the block can be the block-forwarding device or it can also be another device. The block holder device can also be provided as separated device to the apparatus according to the invention, but can be associated to the apparatus. This way, the substantially continuous process of fabricating the endless band is highly efficient.

Moreover, the block holder device and/or the block transport device can be configured to, be capable of holding and/or of transporting more than one block. The block holder device can comprise means for positioning the at least one block, e.g. by rotation and/or by translation of a holder, which holds the blocks. This way, several blocks can be used in a substantially continuous process of fabricating the endless band, which gives more flexibility for designing the endless band.

The apparatus and the components associated with the apparatus can also be part of a station for automatic or semi-automatic fabrication of an endless band, using at least one fiber material block.

Furthermore, a block forwarding device can be provided, which can be part of the apparatus, in particular, of the block holder device, or associated with one of said devices. The apparatus, in particular, the block holder device, preferably, comprises a block-forwarding device, which is configured to forward the block for a predetermined distance in at least one direction, preferably, in a horizontal direction. Said distance is, preferably, equal to the desired thickness of the plate element, which will be cut off in a following step of cutting the block. The block-forwarding device can comprise a displacement member, e.g. a piston for displacing and forwarding the block. Moreover, the block-forwarding device can comprise block-fixating means for fixating the block with respect to a displacement member, which is configured to forward the block-fixating means and also the block. The block-forwarding device can comprise gear wheels, a gear rack, etc. The block-forwarding device can also comprise driving means, e.g. electrical, hydraulic, pneumatic or motorized driving means. The apparatus is preferably, configured such that during the fabrication of the endless band, the fiber material block is automatically forwarded towards the connection end of the endless band, which is the end of the endless band to be arranged side-by-side with the further plate element.

Preferably, block-pressing means are provided for pressing the block, in particular. for pressing the block along (or in) the direction of the cutting direction, which is defined by the direction of a cutting blade that cuts off the plate elements in a linear motion from the face side of the block. The block-pressing means comprises at least two members, a pressing means, and a counter-bearing means, which both can comprise a pressure plate, e.g. having a solid plane surface facing the block. A pressure plate can be configured such that it defines on one edge of the pressure plate, a line, along which the projecting end of the block will be cut off to then yield a plate element. The block-pressing means comprises a pressure means, e.g. a movable piston, which can be driven pneumatically, hydraulically or by other means. The block-pressing means can also comprise a force sensor for monitoring the force, which is exerted when pressing the block. The use of the block-pressing means can enhance the precision of the cut, for cutting off the plate elements from the block.

Preferably, the apparatus comprises a connecting device for connecting at least two plate elements of the endless band. A connecting device can comprise a pressing member for pressing a connecting means against the at least two plate elements. The pressing member can be spring-loaded. The pressing member can comprise a bearing means, e.g. a rotatable drum or a sliding element.

The apparatus can further comprise sensor means for detecting the position of the block, and/or of the cutting device, and/or of the endless band, or of any other components. The apparatus can also comprise temperature sensor means, humidity sensor means, and/or acceleration sensor means. A force sensor can be provided to measure the band holding force. This way, the fabrication of the endless band and the operation of the apparatus can be continuously monitored.

The apparatus can also comprise a control device, e.g. an electrical control device, e.g. a microcontroller, a computing means, a data memory means, a signal connection means, with or without user input/output interfaces, for controlling the operation of the apparatus and the fabrication of the endless band. The control device can comprise a computer program code, and/or program data, or any other data, to automatically or semi-automatically control the operation of the apparatus and the fabrication of the endless band.

Moreover, the apparatus is additionally configured to:

arrange the edge surfaces of the plate element and of the fiber material block in relation to each other, by means of the arranging device such that the main surface of the plate element follows the face surface of the fiber material block, wherein said face surface forms the main surface of a further plate element;

cut off said further plate element from the face side of the fiber material block by means of the cutting device; and to constitute an endless band from the plate element and any further plate elements, wherein the plate element and any further plate element are connected by means of at least one connecting means.

The apparatus according to the invention is intended to be used for working on a fiber material block. However, the apparatus is also appropriate to be used with blocks, which contain or consist of non-fiber material, as long as the block is capable to be cut by the cutting device and be used with the arrangement device. This applies, preferably, in the technical context of construction materials.

Using the present description of the invention, the preferred embodiments and features of the method, the apparatus, the block and the endless band, respectively, can be used to derive any preferred feature for the method, the apparatus, the block and/or the endless band.

Moreover, additional advantages, features, and applications of the present invention can be derived from the following embodiments of the apparatus and the method according to the present invention, with reference to the drawings. In the following figures, identical reference signs substantially, describe identical components.

FIG. 1*a* is a schematic side view of a preferred embodiment of the apparatus according to the invention.

Figure 1B:
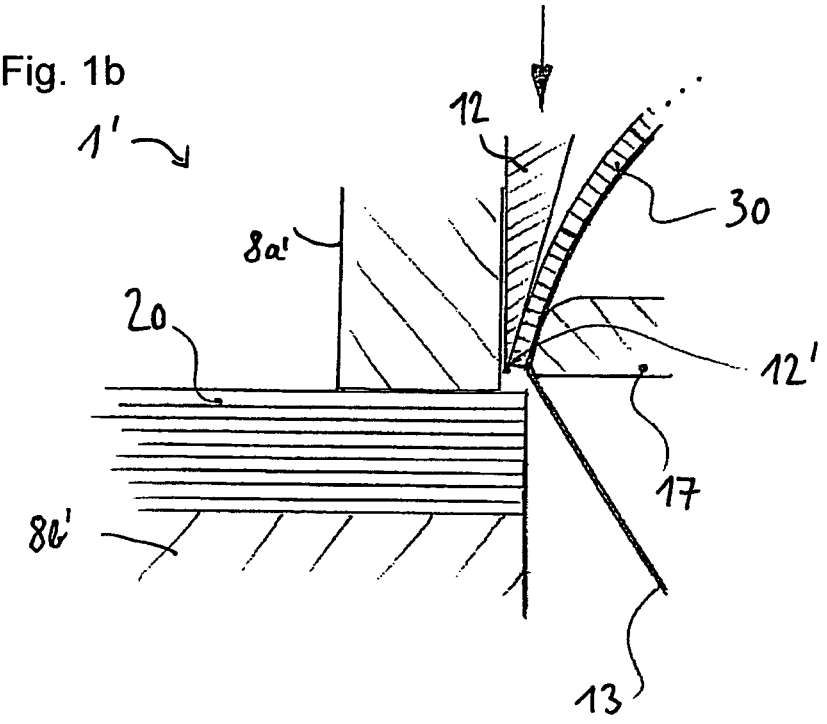

FIG. 1*b* is a schematic side view of another preferred aspect of the apparatus according to the invention.

Figure 1C:
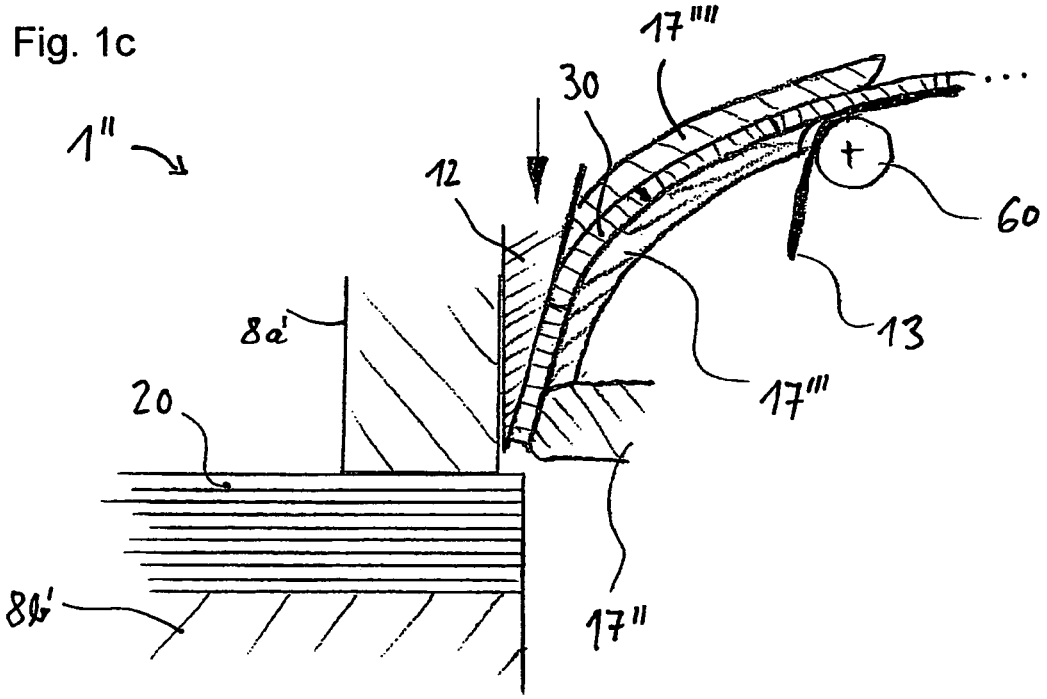

FIG. 1*c* is a schematic side view of another preferred aspect of the apparatus according to the invention.

Figure 2A:
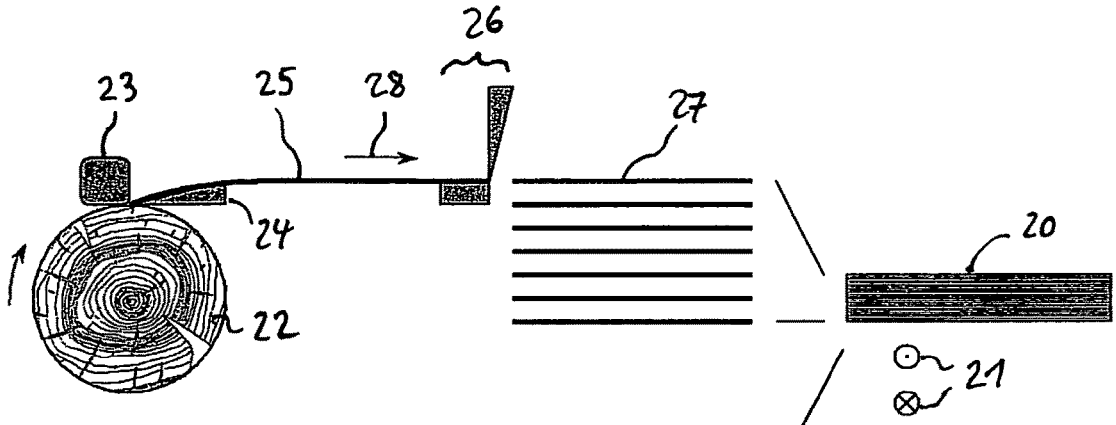

FIG. 2*a* shows schematically a method for producing a layered block of veneers, which can be used for the method and the apparatus according to the invention, to produce a preferred embodiment of the endless band according to the invention.

Figure 2B:
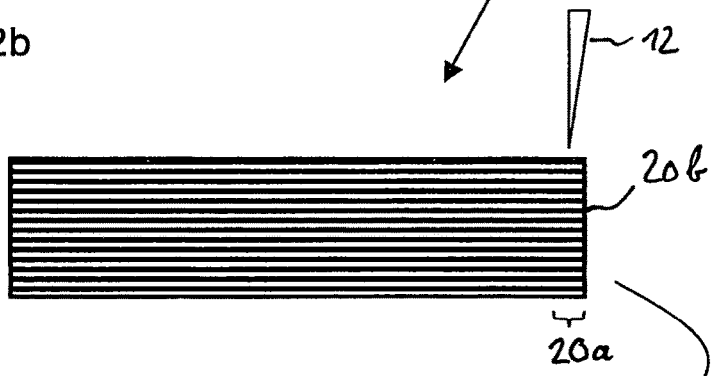

FIG. 2*b* depicts a cross section of a layered block of veneers, e.g. yielded by the method shown in FIG. 2*a*, which can be used for the method and the apparatus according to the invention to produce a preferred embodiment of the endless band according to the invention.

Figure 2C:
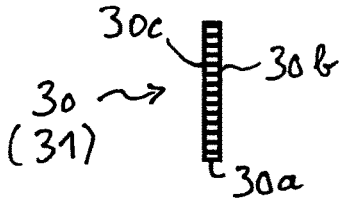

FIG. 2*c* illustrates a cross section of a plate element, which was cut from the block shown in FIG. 2*b*, which can be used for the method and the apparatus according to the invention to produce a preferred embodiment of the endless band according to the invention.

FIGS. 3*a*, 3*b*, 3*c*, 3*d*, 3*e*, and 3*f* show schematically the steps, which are involved to perform, in one embodiment, the method according the invention for producing an endless band according the invention, using the apparatus of FIG. 1 and using the block of FIG. 2*b*.

Figure 4A:
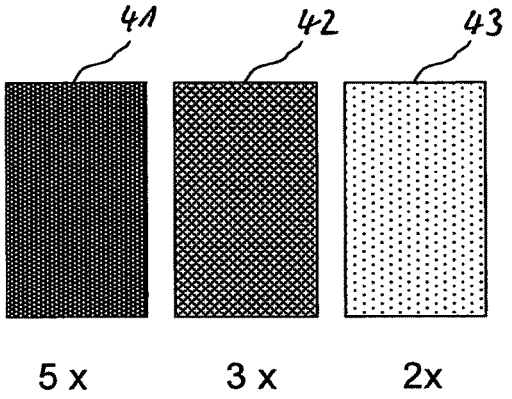
Figure 4B:
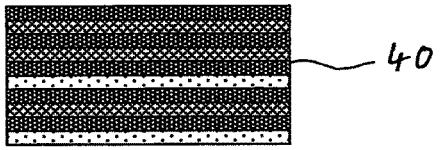
Figure 4C:
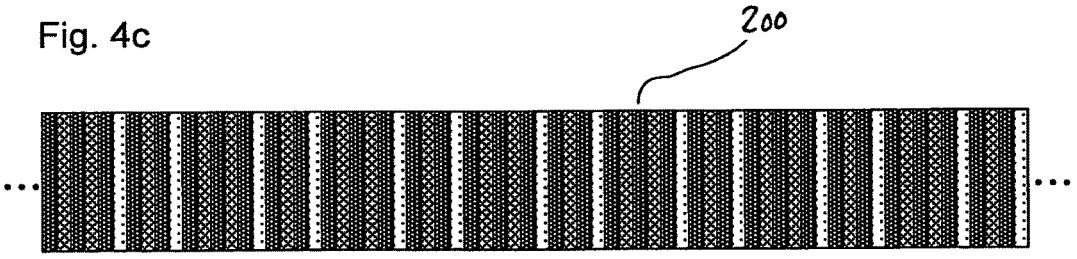

FIGS. 4*a*, 4*b*, and 4*c* outline schematically aspects of the method according to the invention and the fabrication of a preferred embodiment of an endless band according to the invention.

Figure 5A:
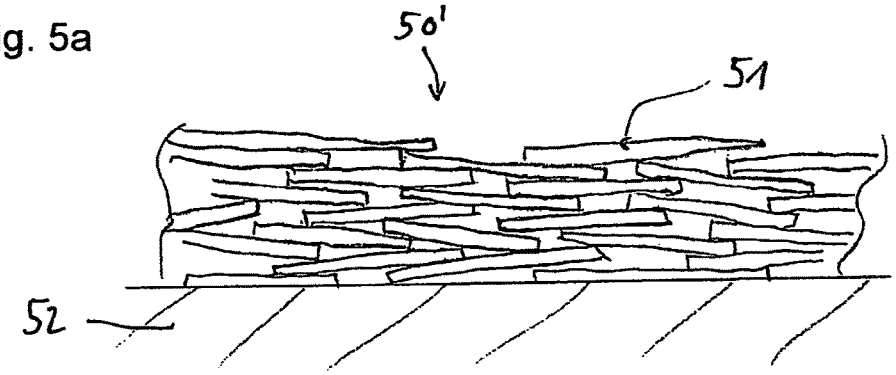

FIG. 5*a* depicts schematically a further block of fiber material, which can be used to produce another preferred embodiment of the endless band according to the invention.

Figure 5B:
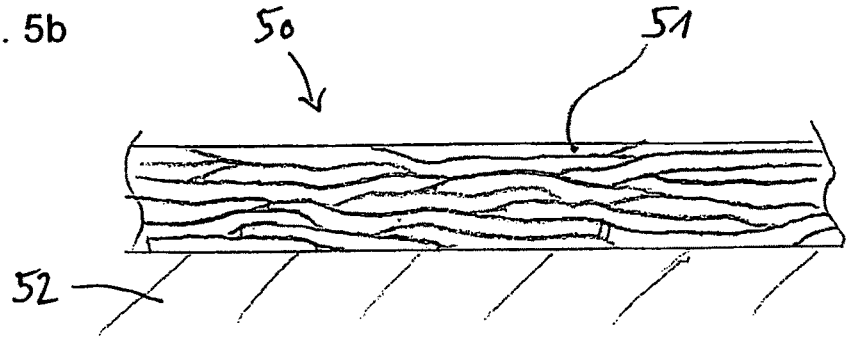

FIG. 5*b* illustrates schematically a further block of fiber material, which can be used to produce a further preferred embodiment of the endless band according to the invention.

FIGS. 6*a*, 6*b*, 6*c* and 6*d* show schematically the steps of another preferred embodiment of the method and the apparatus according to the invention.

FIG. 1*a* shows a preferred embodiment of the apparatus 1 according to the invention. While the method for producing an endless band according to the invention is also exemplarily shown in FIGS. 3*a* to 3*e*, the setup of the apparatus 1 is outlined, in particular, in FIG. 1*a*, with preferred embodiments of the apparatus being illustrated in FIGS. 1*b* and 1*c*.

In FIG. 1*a*, the apparatus 1 has a block holder device 2, a block pressing means 3, and a band processing device 4.

The block holder device 2 has a block forwarding device 5, 6, symbolized by the arrow-elements in FIG. 1*a*, which is configured to stepwise forward the block in the horizontal direction 7, by a step distance, which is equal to the desired thickness of the veneer, being cut off in a subsequent step of cutting the block 10. The block holder device comprises a fixating and guiding device 9*a*, 9*b* for guiding the block during the forwarding process in a restraint-guided manner. The guiding device can be at least intermittently movable or stationary, respectively.

The block-pressing means 3 comprises two pressing members 8*a* and 8*b*, wherein the pressing member 8*a* is vertically movable, as indicated by the double-arrow and the pressing member 8*b*, which acts as a counter bearing, is stationary. The block-pressing means 3 is used for pressing the block 10 in a defined way and also for holding the block along the cutting direction 11, which is defined by the direction of a cutting device 12, namely a blade 12, which cuts off the plate elements from the face side of the block 11 in a linear motion. The use of the block-pressing means 3 enhances the precision and the quality of the cut, or cutting off the plate elements from the block.

The apparatus 1 is configured to automatically repeat the following three motions, which are preferably, temporarily correlated with each other by fixed time periods:

a forwarding motion by the block-forwarding device 5, 6;

a pressing motion by the block-pressing means 3;

a cutting motion by the cutting device 12;

During said three motions, a band-processing device 4 is used substantially, to connect the plate elements with the connecting means 13, by applying the veneers and/or the plate elements, respectively, to a self-adhesive endless band 13, which is coiled up on a connecting band storage drum 15. The fabricated endless band will then exit the band processing device 4 in the direction of the arrow 14.

The band processing device 4 further comprises the arranging device 16, 17, which comprises a movable frame 16 and a sliding element 17. The arranging device serves to arrange the plate elements and/or the endless band with the block, thereby helping to form the endless band of the invention. The blade 12 can also be seen as a part of the arranging device, because the veneer 30 or the endless band 100, respectively, are also held and arranged by the blade 12. This means, that at least one part of the cutting device can be considered to also be a part of the arranging device, i.e. the arranging device can comprise the cutting device at least in part.

The frame 16 is movable at least along the direction 11, indicated by the double-arrow 19. In the outlined embodiment, the cutting device 12 is fixated to the frame 16 of the band processing unit 4). This, is a preferred embodiment, but however, not mandatory for the present invention. The entire band processing device 4 is movable at least in the direction 11, indicated by the double-arrow 19. This, is also a preferred embodiment, but however, not mandatory for the present invention. With respect to the frame 16, the sliding element 17 is movable in the direction of the fixating force 18 and, within a certain range of tolerance, able to press the plate element against one part of the arranging device, here, against the side surface of the blade 12. The sliding element and the band processing device 4 are configured such, to press the section of the endless band not shown in FIG. 1*a*, which was fabricated in the previous step, against the blade 12 with a defined pressure, which allows that the endless band slides out in the direction 14 between the blade 12 and the sliding element 17 of the band processing device 4.

In FIG. 1 *b*, a configuration detail of an apparatus 1' is shown, wherein a sliding element 17 is used to apply a pressure on the end section of a plate element 30, which—temporarily during the fabrication process—forms an end of the endless band. The pressure is sufficient for pressing and connecting the endless connecting band 13 to the plate element of the endless band. An edge of the pressing surface of the pressing member 17 is arranged in opposite to the tip of the cutting blade 12, such that the endless connecting band 13 is substantially simultaneously connected to the face surface 20*b* (see FIG. 2*b*) at the position of the blade tip, which penetrates the block 20 of layered veneer, while the further plate element 31 is cut off from the block 20. This way, the endless band is immediately stabilized by the connecting means during fabrication of the endless band.

In FIG. 1 *c*, a configuration detail of another apparatus 1" is shown, wherein another sliding element 17' is used, which comprises a first sliding element member 17" and a second sliding element member 17'". Here, the apparatus and the sliding element is used to guide the end section of the endless band along a length L of the sliding element, during a time t. Thereby, the endless band is allowed to release internal stresses during the time t, before the plate elements are connected by the connecting means, here, the endless connecting band 13. "v" is the speed of the endless band running along the sliding member during a fabrication step of the endless band, and it is preferably also the cutting speed of the blade 12, penetrating the block 20. The relationship v=L/t is fulfilled, in case the speed is constant. Instead of using a first and a second sliding element members 17" and 17'", or additional parts, the sliding element 17' can also be made integral (not shown). In FIG. 1*c*, the band-processing means of the apparatus further comprises a pressing member 60, e.g. a rotatable drum, which is stationary with respect to the band-processing device, and which can be spring-loaded. Pressing member 60 serves to press and connect the endless connecting band 13 against the plate elements of the endless band. The pressing member is a part of the connecting device of the apparatus. The pressing member 60 is arranged in a distance L from the tip of the blade 12, measured along the length of the endless band. The pressing and guiding of the band elements 30 along the length L and preferably, also the pressing of the endless connecting band 13 against the plate element 30 is supported by the third sliding element member 17"", which acts as a counter bearing.

In FIGS. 1*b* and 1*c*, the apparatus is respectively shown in a status of operation, directly before the edge surface of the endless band is arranged onto the top of the face side of the block, abutting there. During this operation, the block 20 is pressed and fixated by block-pressing means 8*a*' and 8*b*'.

Referring to FIG. 1*a*, the fiber material block 10, used for the invention, can have various configurations, which respectively implies that the resulting endless band can have various desired properties.

FIGS. 2*b*, 4*b*, 5*a*, and 5*b* respectively, show examples of preferred embodiments of a fiber material block.

FIG. 2*b* depicts an embodiment of a fiber material block and its fabrication by peeling of a wood log, as see in FIG. 2*a*. The layered block is used in FIGS. 3*a* to 3*f* to describe one embodiment of the method according to the invention.

In FIG. 2*a*, the devices used for fabricating a layered veneer block 20 are not part of the apparatus according to the invention, but could be part of an automatic or semi-automatic station for fabricating an endless band. A tree log 22, is rotated around its length axis, and thereby, an endless veneer 25 is peeled off from the tree log 22 by means of a pressing and sliding member 23 and a peeling blade 24. The endless veneer 25 exits the peeling station in the direction of the arrow 28 and is subsequently clipped by a clipping station 26 into pieces of veneer 27, which are then stored. The veneer pieces 27 are selected, sorted by quality, and cut in the appropriate dimensions. The veneer pieces 27 are aligned and stapled to a stack of veneers, such that the direction of the wood fibers is in parallel, namely parallel to the main surfaces and the long side edges of the stack. The direction of the fibers is perpendicular to the surface of the drawing page, symbolized by the symbols 21. The veneers in the stack, which can be laminated, are pressed together. The stack can be cut again to create a precise rectangular block 20 of stacked veneers. Thereby, the block and the resulting endless band have a texture similar to the natural texture of the cutting surface of a tree log, which was halved along its length. Such a texture is most often desired for aesthetic values.

In FIG. 2*c*, a plate element 30, 31 is shown, which was produced from the block 20 as outlined in FIG. 2*b*, thereby, resulting into a plate element, which is constituted of strip elements, which are arranged side-by-side. Generally, a plate element has a cutting surface 30*c* resulting from the fiber material block, a main surface 30*b*, facing the cutting surface, and an edge surface 30*a* connecting the cutting surface and the main surface.

FIGS. 3*a*, 3*b*, 3*c*, 3*d*, 3*e*, and 3*f* outline schematically the steps, which are involved to perform in one embodiment the method according the invention for producing an endless band according the invention, using the apparatus of FIG. 1 and the block of FIG. 2*b*. In the embodiment depicting the apparatus 1, the only stationary part is the pressing member 8*b*, while the block holder device 2 with the block 20, the pressing member 8*a*, and the band-processing device 4 are movable with respect to the pressing member 8*b*.

Figure 3C:
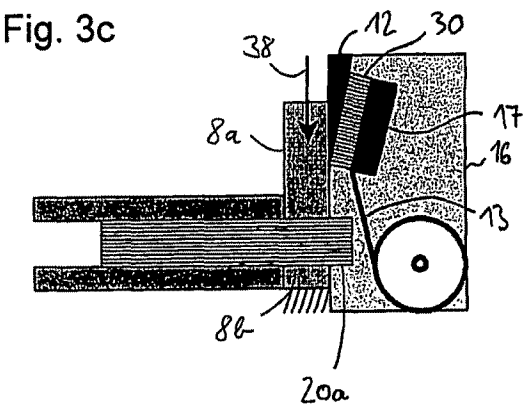
Figure 3B:
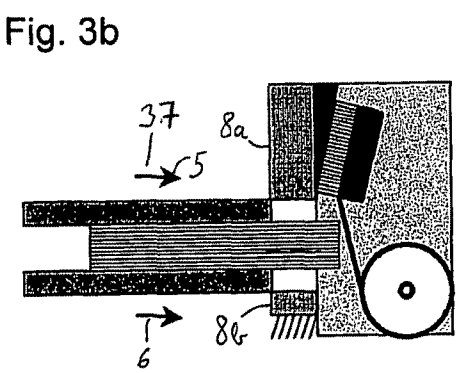
Figure 3A:
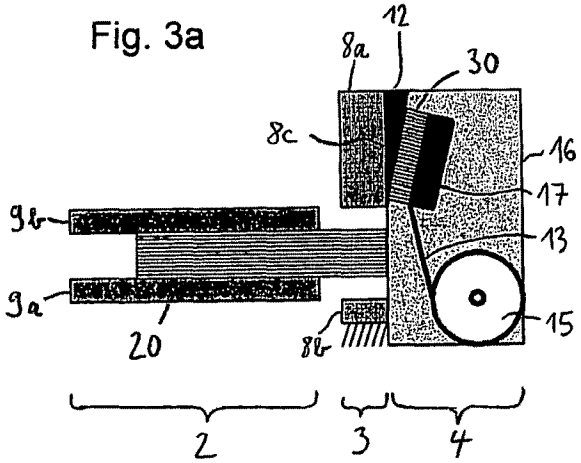

In FIG. 3*a*, the block 20 is the basic material for producing the endless veneer band 100. In FIG. 3*a*, the block holder device 2, in particular, the fixating and guiding means 9*a*, 9*b*, and the block 20 are in their starting position, which represents the position after cutting off a plate element 30, namely a veneer 30, from the face side 20*a* (see FIG. 2) of the block 20. The veneer 30 has the cutting surface from the fiber material block, which is in FIG. 3*a* pressed to the blade, and a main surface, facing the cutting surface. This main surface is pressed against the plane sliding surface of the sliding element 17, whereby the main surface is also pressed against the endless connecting band 13, which is positioned between the main surface, and the sliding surface. The edge surface is connecting the cutting surface and the main surface of the veneer 30.

The face surface 20*b* of the block is positioned within the plane, which is defined by the side surface 8*c* of the pressing member 8*a* or the opposing vertical side surface of the blade 12, respectively. The surface 8*c* acts also as a guiding surface for guiding the blade 12 during the cutting motion, thereby achieving a precise cut from the block. In FIG. 3*a*, the block 20 is fixated by the movable holder device 2. In FIG. 3*a*, the block-pressing means 8*a* and 8*b* are released once the blade 12 reaches its upper turning position (shown in FIG. 3*a*). Due to this, the block 20 can be moved by the forwarding device. FIG. 3*b* shows how the forwarding device of the block holder device 2 forwarded the block 20 with the help of the fixating and the guiding means 9*a*, 9*b* in a horizontal direction of the arrow 37 to the right, towards the blade 12. The forwarding is done in a distance, which is equal to the thickness of the veneer 30 and of the endless band 100. Said direction is perpendicular to the direction of the parallel fibers of the block 20. During the fabrication of the endless band, the block is always by precisely the same distance and automatically forwarded in said direction. The position of the band-processing device 4 did not change with respect to FIG. 3*a*. The operation of the forwarding device of the apparatus 1 is fully automatic.

In FIG. 3*c*, the block-pressing means 8*a* and 8*b* have been approached in the direction of the arrow 38, consequently, the block is pressed (compressed) along said direction and fixated such that a precise cut can be performed.

After fixating and pressing the block as depicted in FIG. 3*c*, the arranging device 16, 17, which comprises the movable frame 16 and the sliding element 17, will arrange the cutting surface 30*c* of the veneer 30 from the block 20 such that the main surface 30*b* of the veneer follows the face surface 20*b* of the block 20, and wherein said face surface forms the main surface of a further plate element 31.

Figure 3F:
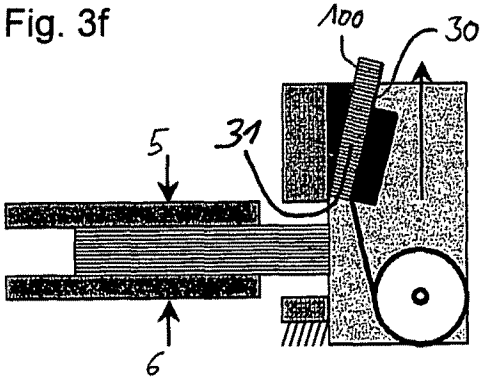
Figure 3E:
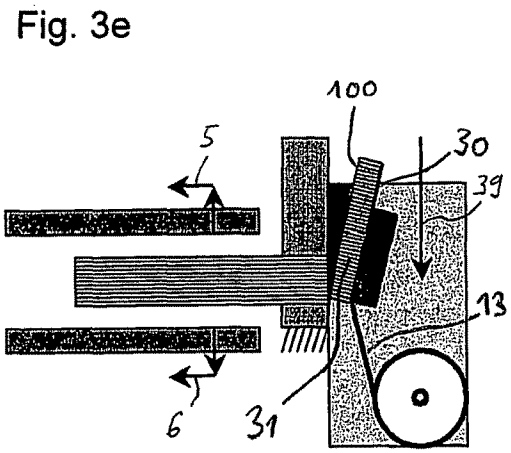
Figure 3D:
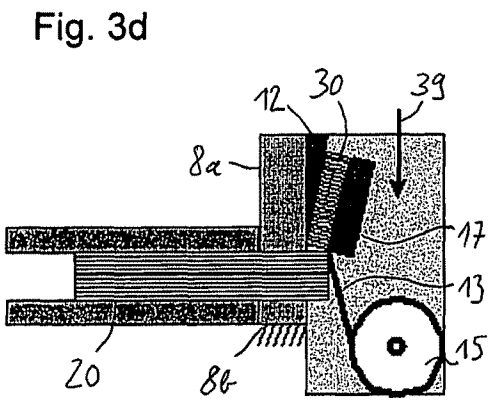

Generally, it is also possible that the band-processing device 4 (and/or the cutting device 12) is/are stationary and that an additional arranging device is configured to arrange the block to the plate element. Furthermore, it is possible, that the block-holder device comprises lifting means to lift the block towards the possibly stationary cutting device 12. In the embodiment of FIGS. 3*a* to 3*f*, the arranging device 16, 17, 12 arranges the veneer 30, which can also be the previously cut plate element (veneer section of the endless band), at the block 20, subsequent to the step depicted in FIG. 3*c*, such that at least one or otherwise all of the following conditions are fulfilled:

i) an edge surface of the plate element 30 approaches the face side 20*a* of the block 20, following the direction of the arrow 39 shown in FIG. 3*d*,
ii) the plate element 30 abuts on the top side of the face side 20*a* of the block 20 (shown in FIG. 3*d*),
iii) an edge line of the edge surface of the plate element 30 is aligned with an edge line of the top side of the face side 20*a* of the block 20 (shown in FIG. 3*d*),
iv) a glue is applied to an area of the top side of the face side 20*a* of the block 20, before cutting off a further plate element 31;
v) the pressure, which is exerted by the sliding element 17 and the surface of the blade 12 to fixate the plate element 30, is reduced, when the plate element 30 abuts on the top side of the face side 20*a* of the block 20, or shortly after, but preferably, before the arranging device is moved to perform the cutting motion of the cutting device 12, which is fixated to the arranging device; alternatively said pressure remains substantially constant during the fabrication of the endless band.

In FIG. 3*e*, the face side 20*a* of the block 20 from FIG. 3*a*-3*d* was cut off, and was added as the new plate element 31 to the plate element 30, thereby starting or continuing the fabrication of the endless band, followed by the return of the band-processing device to its starting position (see FIG. 3*f*). Thereby, the only difference of FIG. 3*f* compared to FIG. 3*a* is, that the veneer 30 is replaced by the connected veneers 30 and 31.

During the cutting motion, the face surface 20*b* of the face side 20*a*, which will become the main surface of the newly cut off plate element 31, is continuously connected to the endless connecting band 13, which is automatically uncoiled from the drum 15, while the band-processing device 4 is lowered. It is possible and preferred that the cutting process of cutting off the plate element from the block and the action of connecting the connecting means to the face surface of the block start substantially, at the same time, in accordance with the embodiment of the apparatus 1' shown in FIG. 1*b*. However, it is also possible and preferred that the connecting means is connected with the face surface of the block before or after the cutting process has started, the latter case being in accordance with the embodiment of the apparatus 1" shown in FIG. 1*c*. It is preferred that the connecting means is connected with the main surface of the previously cut off plate element 30, after having cut off the new plate element 31, and, in particular, that the connecting means is not connected to the block, but is preferably, connected the endless band while the endless band is passing the arranging device (FIG. 1*c*).

The connecting means is step wise and/or in part continuously applied to the block and/or to the plate element. The sliding element 17 or 17', preferably, causes a defined status of friction of the endless band passing the arranging device. The status of friction is adjusted such that the specific compressibility of the block material is recognized and that all endless band are of equal quality, in particular, without substantial variations of the inner stress of the endless band.

Preferably, the synchronization of the forwarding motion, of the arrangement motion, and of the cutting motion is automatically performed by the apparatus according to the invention. The apparatus is configured such that the forwarding device and/or the arranging device, and/or the cutting device are working synchronized, which allows for a substantially, continuous operation of the apparatus, preferably, fabricating an endless band with seamless connected plate elements.

Figure 6A:
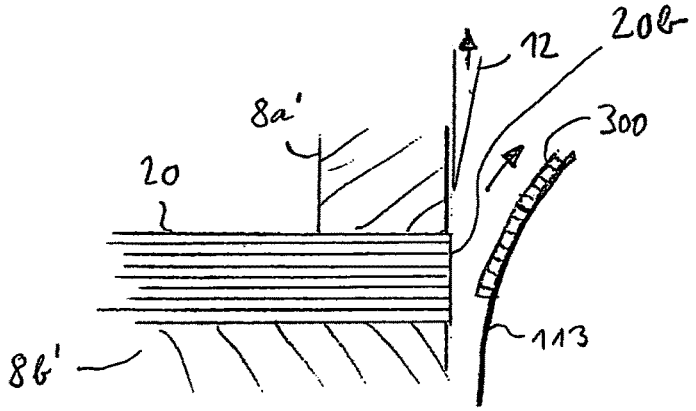

FIGS. 6*a* to 6*d* show the steps of a preferred embodiment of the method according to the invention, using a preferred embodiment of the apparatus according to the invention. Compared to the embodiments in FIGS. 1*a*, 1*b* and 1*c*, the embodiment in FIGS. 6*a* to 6*d* uses a different time for connecting two adjacent plate elements of the endless band with the connecting means, with respect to the time of starting and ending the cutting process:

In the embodiment of FIGS. 6*a* to 6*d*, the connecting means, namely the endless connecting band 113, which is already connected to the endless band 300, is connected to the face surface of the fiber material block 20, before the further plate element is cut off from the block. In detail: In FIG. 6*a*, the endless band 300 is already provided with the endless connecting band 113. The arrangement device of the apparatus is not shown in FIGS. 6*a* to 6*d*.

Figure 6B:
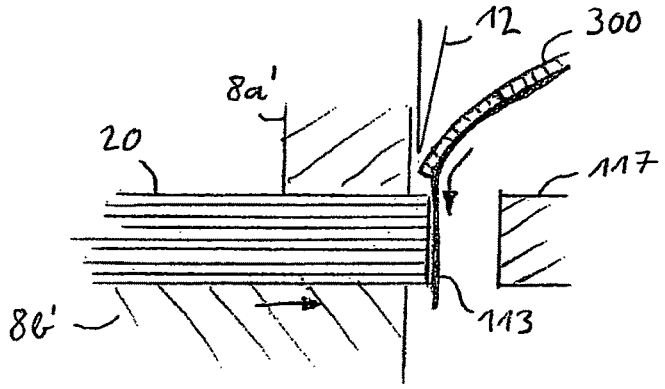

In FIG. 6*b*, the block 20 has been forwarded by the distance to be cut off from the block 20. The endless band 300 with the endless connecting band 113 is arranged at the block 20 such that the edge surface of the endless band 300 is moved to the top surface of the face side 20*a* of the block. This movement is indicated in FIG. 6*b* by the arrow pointing downwards. During this movement, the endless connecting band 113 is not yet connected to the face surface 20*b* of the block.

Figure 6C:
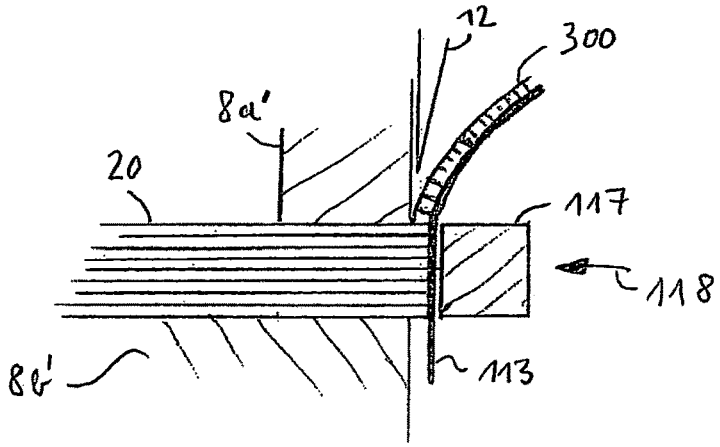
Figure 6D:
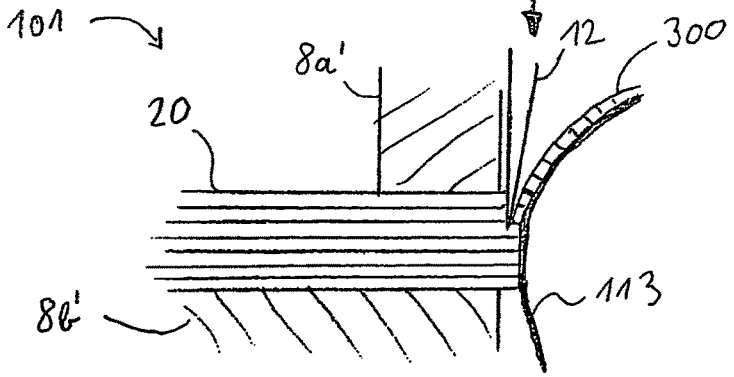

In FIG. 6*c*, the edge surface of the endless band 300 has abut on the block, and the connecting band 113 is pressed and thereby connected to the face surface 20*b* of the block by the pressing means 117, which acts as the connecting device. The pressing means can be heated to apply heat to the connecting means. This way, the endless band 300 is temporarily connected to the block 20, before the further plate element is cut off from the block in FIG. 6*d*.

FIGS. 4*a*, 4*b*, and 4*c* show a preferred embodiment of the endless band, wherein the sequence of the plate elements 41, 42, 43 within the block 40 is predetermined such that a predetermined sequence is also achieved in the endless band, which is fabricated from said block 40. Three types of veneers are shown in FIG. 4*a*, namely a first veneer 41, which is five times in stock, a second veneer 42, which is three times in stock, and a third veneer 43, which is twice in stock. The object of this embodiment is to form an endless band with homogeneous properties from the veneers in stock such that a minimum of refuse material of veneer is produced, while at the same time a maximum length of the endless band is achieved. In the endless band 200 according to the invention, which preferably was fabricated according to the method according to the invention, preferably using the apparatus according to the invention, a homogeneous distribution of the veneers in stock is achieved, resulting in an endless band of homogeneous properties. These properties can, for example, be the visual appearance, which is created by a periodic arrangement of the sequences of the veneers 41, 42, 43 in the block 40. Said sequences of the block 40 are specifically calculated to optimize, e.g., the distribution of brightness of the surface of the endless band 200 with respect to its homogeneity. An additional property could be mechanical property, for instance if some veneers 41 have a higher compressibility than other veneers 41 and 42, resulting in a uniform mechanical load capacity of the endless band.

Method for Forming a Fiber Material Block, in Particular, an Endless Fiber Material Block 50 from Fragments FIG. 5*a* shows schematically a section of an additional block of fiber material, which can also be used to produce another preferred embodiment of the endless band according to the invention. Block 50' contains fragments of fiber material: therefore, veneer strips and/or plates 51 (and/or otherwise shaped fragments) are arranged in a staple block 50', which is supported onto a support platform 52. The fragments within the block 50' are stacked and distributed randomly, and are overlapping each other. The number of fragments within each cross section of the block 50' is substantially, the same, within a range of tolerance of less than 10%, 5%, 2%, or 1% or different.

In FIG. 5*b*, the block 50' of FIG. 5*b* was compressed, such that within the overlapping regions of the fragments, and within the positions of reduced density of fragments substantially, no material defects of the block 50 exist. Such a fiber material block 50 can be produced endlessly (hence, "endless"), because the steps of adding and compressing fragments can be performed continuously. Therefore, an endless band of extended length can be produced easily by using a block—like block 50—and the apparatus according to the invention. The resulting endless band has substantially homogeneous properties along the width and the length of the endless band, in particular it has a homogeneous visual appearance, corresponding to the "spectrum" of fragments used for forming the block 50.

A particular advantage of the block 50 and of the method for forming the block 50 is, that small fragments of arbitrary format and arbitrary thickness can be used, which preferably, do not comprise a cutting surface or any glue joining the layers of the block, which is usually required by layered blocks like the block 20. Therefore, the fragments can be of refuse material or of residual material, which can be chipped or otherwise treated before forming the block 50. This way, also a solution was found to exploit or recycle wood and veneer refuse material. Generally, "fragments" are not restricted to parts which are generated by separating larger parts, however, it is preferred, that this would be the case. Preferably, a fragment is a small part, preferably, smaller than the height HB (or HB*0.5 or HB*0.25 or HB*0.1) of the block to be fabricated, preferably smaller than the following preferred ranges of its dimensions height H, width W, and length L:

$$\{0.1;0.5;1;2;3;4;5\}\ \text{mm} <= H;W;L <= \{1;5;10;15;20;30;50;100;150;200;300;500\}\ \text{mm};$$

The method for forming a fiber material block, in particular, an endless fiber material block 50 from fragments, in particular, sheet fragments of fiber material, in particular, wood, comprises the step of the manual or automatic laying of fragments, or packages, or fills of fragments. Known density-sensing methods and thickness sensors can be used to monitor and control the number of fragments. The fragments can also be processed to have a uniform shape and/or size, and/or mass. Moreover, it is also possible to use position sensors, e.g. optical sensors, and/or electrical control devices, and/or manipulation means for manipulating the position, and/or the orientation of the fragments within the bed of fragments, wherein the manipulation means can be arranged downstream after the laying of the fragments. Said manipulation means can also be found within the generally known production of OSB-boards. Here, strips of wood, which are sifted and then, oriented on a belt or on wire cauls, to form a mat, are used. An example for an OSB-board fabrication process can be found in WO 1999/047321 A1. For creating the block 50, stapled or laid fragments can be pressed. A glue, a water-comprising adhesive, or any other glue can be used respectively, to connect the fragments with each other. One advantage of this method is the high homogeneity of the resulting block 50, which increases with decreasing format, size, or volume of the fragments. Said method is strongly applicable for automation.

Instead of using veneer fragments, it is rather preferred that the block comprises veneer-like chips, similar or equal to the chips, which are used for OSB-production. A further advantage of this method is that the known, OSB-manufacturing technology can be used, at least in part, to form blocks 50, using wood chips (OSB-chips) and the known OSB-system engineering.

According to a further embodiment of the block 50, instead of using a "closed structure" of fragments within the block, e.g. instead of using a "compressed structure" substantially without gaps and material defects, the fragments can be arranged such that hollow spaces are provided between a substantial fraction of or substantially, between all of the fragments. Said hollow spaces can be randomly distributed over the entire block volume, which would be easier for fabrication, or they could be positioned in a substantially, defined manner over the block volume, which would make designing and predicting the properties of the resulting block and the endless band, easier. Even in this case, the block can still be compressed. Also, a glue could be provided to connect the fragments with each other. The block with hollow spaces has a reduced density, and is preferably, used to fabricate a lightweight-endless band, using the method according to the present invention. Such a lightweight-endless band can be used to produce lightweight-building parts, e.g. the core elements of lightweight-plates. Combining at least one endless veneer band as an endless cover band with at least one lightweight-endless band to form a layered endless band, can then result in a layered endless-lightweight band.

In one example of producing a block 50 from fragments: the veneer fragments can have a length of 50 mm, a width of 20 mm, and a thickness of 1.8 mm. In a glue drum, the veneer fragments are then provided with a dispersion adhesive. Using a belt, said treated veneer fragments pass through a manipulation device to align the orientation of said veneer fragments. Additionally, they pass through a mat-forming device, in which a mat of 300 mm height and width of equally oriented veneer fragments, is put out. Said mat is then compressed by a pressing means to a height of 240 mm, and provided with water vapor, to reactivate the dispersion adhesive and to cause hardening of the mat. Simultaneously, the veneer fragments become plasticized by the vapor and in cooperation with the glue such that the compression becomes fixated. The block, fabricated this way, is immediately used, while the block is still hot, to generate an endless band of 3 mm thickness. Preferably the block has still a temperature of 30-95° C. or 50-85° C. during fabrication of the endless band. The resulting endless band has a fraction of 45 vol % of hollow spaces between the veneer strips (similar to FIG. 5*a*) and is then used to form a core layer for the fabrication of a lightweight-sandwich elements.

The invention claimed is:

1. A method for fabrication of an endless band from a fiber material block comprising:

(a) cutting off a plate element from a face side of a fiber material block, wherein the plate element comprises (i) a cutting surface from the fiber material block, (ii) a main surface facing the cutting surface, and (iii) an edge surface connecting the cutting surface and the main surface;

(b) arranging the edge surface of the plate element with the fiber material block such that the edge surface abuts the fiber material block;

(c) connecting the plate element and the further plate element to begin fabrication of an endless band; and (d) cutting the further plate element from the face side of the fiber material block wherein the further plate element has (i) a cutting surface from the fiber material block, (ii) a main surface facing the cutting surface, and (iii) an edge surface connecting the cutting surface and the main surface, wherein the plate element and the further plate element are connected before the further plate element is cut from the fiber material block.

2. The method according to claim 1, wherein the fiber material block is comprised of wood.

3. The method according to claim 1, wherein the connecting of (c) utilizes a connecting band.

4. The method according to claim 3, wherein the connecting band is connected to the plate elements by at least one of the following: glue, nails, hooks, screws, hook-and-loop fasteners, adhesive thread, adhesive fibers, adhesive tissue, adhesive foil, adhesive plastic, or plastic melt.

5. The method according to claim 1, wherein (b)-(d) are repeated until a desired length of the endless band is achieved.

6. The method according to claim 1, wherein the arranging of (b) results in the plate element abutting the fiber material block.

7. The method according to claim 5, wherein the arranging of (b) results in the plate element abutting the fiber material block.

8. The method according to claim 1, wherein the step of cutting the further plate element from the face side of the fiber material block further comprises automatic forwarding of the fiber material block towards a connection end of the endless band, wherein the connection end of the endless band is the end that is arranged side by side with the further plate element.

9. The method according to claim 5, wherein the step of cutting the further plate element from the face side of the fiber material block further comprises automatic forwarding of the fiber material block towards a connection end of the endless band, wherein the connection end of the endless band is the end that is arranged side by side with the further plate element.

10. The method according to claim 1, wherein the cutting is performed while the fiber material block is held stationary.

11. The method according to claim 5, wherein the cutting is performed while the fiber material block is held stationary.

12. The method according to claim 1 wherein the plate element includes an edge line at the intersection between the edge surface and the main surface of the plate element, and the fiber material block includes a second edge line at the intersection between the face side and a face surface of the fiber material block, wherein said face surface forms the main surface of a further plate element, and wherein the step of arranging the edge surface of the plate element with the fiber material block further comprises aligning the edge line of the plate element with the second edge line of the fiber material block.

* * * * *